US006421931B1

(12) United States Patent
Chapman

(10) Patent No.: US 6,421,931 B1
(45) Date of Patent: Jul. 23, 2002

(54) METHOD AND APPARATUS FOR DRYING IRON ORE PELLETS

(76) Inventor: Daniel R Chapman, 5750 N. Camino Esplandora #121, Tucson, AZ (US) 85718

( * ) Notice: Subject to any disclaimer, the term of this patent is extended or adjusted under 35 U.S.C. 154(b) by 0 days.

(21) Appl. No.: 09/851,024

(22) Filed: May 8, 2001

(51) Int. Cl.[7] ..... F26B 7/00

(52) U.S. Cl. ..... 34/424; 34/508; 34/509; 34/510; 34/210; 34/230

(58) Field of Search ..... 34/424, 508, 210, 34/230, 509, 510

(56) References Cited

U.S. PATENT DOCUMENTS

| | | | |
|---|---|---|---|
| 2,671,968 | A | 3/1954 | Criner |
| 3,868,245 | A | 2/1975 | Boss |
| 3,868,246 | A | 2/1975 | Boss |
| 3,893,233 | A | 7/1975 | Malcolm |

OTHER PUBLICATIONS

Haas L.A. and K.W. Olson. Effects of Magnetite Oxidation on the Properties of Taconite Pellets. Paper in Proceedings of 64th Annual AIME Meeting (Duluth, MN, Jan. 16–17, 1991) SMME(AIME), 1991, pp377–394.

Haas L.A. et al. Use of Oxygen–Enriched Gas for the Oxidation of Acid and Fluxed Taconite Pellets. BuMines RI 9473, 1993, 15 pp.

Meyer K. Pelletizing of Iron Ores. Springer–Verlag Press, Berlin, Germany, 1980, pp24–37.

Meyer K.J.E. and H. Rausch. The Lurgi Pelletizing Process: A Combined Updraft–Downdraft Technique. J. of Metals, V. 10, 1958, pp129–133.

*Primary Examiner*—Denise L. Esquivel
*Assistant Examiner*—Mark Shulman
(74) *Attorney, Agent, or Firm*—James V. Harmon

(57) ABSTRACT

In the present method of drying iron ore pellets, e.g., magnetite pellets, moisture-containing iron ore pellets are formed into a bed comprising a multiplicity of the pellets. A current of drying gas is forced through the bed of pellets to at least partially dry some of the pellets. At least one jet of a drying gas that contains added oxygen is directed onto the bed of pellets so to impinge upon a surface of the pellet bed thereby providing kinetic energy for directing oxygen including the added oxygen into the pellets so as to enhance the conversion of magnetite to hematite. Moisture can be added to heated air that is then blown through jet nozzles onto the pellet bed or circulated back to an earlier drying stage and passed through the bed.

30 Claims, 18 Drawing Sheets

MOISTURE CONTENT OF PELLETS
WITHOUT DOWNDRAFT JETS
50
52
15 14 13
12 11 10
9 8 7
6 5 4
3 2 1
Bed thickness in inches
WB1
WB2
WB3
WB4
WB5
WB6
WB7
WB8
0 — 1min. — 2min. — 3min. — 4min. — 5min. — 6min. — 7min. — 8min.
KEY FOR FIGURES 7 AND 8
Condensed water added >11%
10–11% water
Original water content eg 10%
<10% water
<6% water

MOISTURE CONTENT OF PELLETS WITH DOWNDRAFT JETS

PELLET TEMPERATURES °F
Bed thickness in inches
Zone 5
Zone 4
Zone 3
Zone 2
Zone 1
WB1
WB2
WB3
WB4
WB5
WB6
WB7
WB8
KEY
Temperature with invention
Temperature without downward jet High Pellet Temperatures 21% $O_2$
100
105
104
14
107
Oxidation Layer
WB 13
WB 14
WB 15
WB 16
WB 17
WB 18
WB 19
WB 21
WB 21

100
104
108
121
122
109
14
Oxidation Layer
107
14
WB 13
WB 14
WB 15

METHOD AND APPARATUS FOR DRYING IRON ORE PELLETS

FIELD OF THE INVENTION

This invention relates to drying processes, and more particularly to a method and apparatus for drying iron ore pellets.

BACKGROUND OF THE INVENTION

Several processes have been in use over the years for drying green, i.e., moist, iron ore pellets, e.g., hematite, magnetite or limonite. The objective of these processes is to remove residual moisture so as to produce a strong fired pellet having maximum abrasion and breakage resistance as adjudged by crushing tests, optimum porosity and, where stored in cooler climates, good resistance to repeated freezing and thawing. In treating certain ores the process should also provide optimal oxygenation, since poor strength may otherwise result in the case of magnetite pellets where oxidation to $Fe_2O_3$ is not complete, leaving magnetite cores in the center of the pellets.

Prior methods employed in drying iron ore pellets will now be described briefly by way of example in connection with the drying of magnetite pellets obtained from taconite. It should be understood, however, that although the present invention is described in connection with a particular ore, it is not limited to specific apparatus or processes described.

For the last 45 years, the beneficiation of magnetite-containing rock has consisted of crushing, grinding and milling the ore. The specific operation consists of separating the desired material from the gangue (waste) material through hydraulic separation, magnetic separation, and by chemically treating the ore to further enhance the separation of the ore from the waste rock.

The material separated from the waste material is called concentrate. The total iron may range from 65% to 69% or other economically practical value. The concentrate is generally described as a powder with the general size that can pass through a screen of a selected size. The screen usually used is an U.S. Standard Tyler Screen of 325 and 500 mesh to the inch. The 500-mesh screen has openings about 27 microns in diameter.

Some of the general size descriptions might be 85% minus 325 mesh and 75% minus 500 mesh as an example. The percentage values correspond to the amount of grinding necessary to liberate the desired product from the waste product. The grinding, milling and treatment of the ore generally occur in a section of the plant called the concentrator, hence the name concentrate.

The concentrate is generally piped in an aqueous slurry of 60% solids to a vacuum filter. The vacuum filter removes most of the water from the slurry. The resulting product is called a filter cake with generally less than 10% water. The amount of water is controlled by the efficiency of the filtering operation and also by the size of the particles in the concentrate. The concentrate (filter cake) is generally conveyed to storage bins before being fed into a disk or drum-balling device.

The concentrates have additives to improve the balling, firing or chemical composition of the product once it has been fired. Some of the common additives are bentonite clay, limestone in the form of calcium hydroxide if fluxed pellets are produced, and sometimes an organic binder.

The balling of concentrate is accomplished in a process in which the material is rolled in stages that increase the size of the pellet by applying a layer of concentrate upon a smaller pellet until the pellet reaches the desired size. The product from a balling drum is screened to selectively size the product. The undersized material is circulated back into the balling drum. The circulated material is called seed pellets. The balling action applies the concentrate to minimize interstitial spaces; hence, smaller particles are forced between larger particles. The mixture of particle sizes makes a pellet of maximum density. The additives also fill the interstitial spaces and often provide a pathway for the gradual removal of water from the inside of the pellet. Pathways are also provided for oxygen to enter the inside of the pellet during the firing of the pellet. Knowledge of the removal of water from the inside of pellets is necessary to appreciate the contributions that the present invention provides towards the firing of magnetite pellets. An adequate preliminary description of the equipment and the mineral beneficiation process has been provided. It is also necessary to describe the physical and chemical changes in each section of a pelletizing machine.

The prior drying process and some of the limitations of that system which negatively impact on the next stage of the pelletizing process (the firing of the pellets) will now be described. It should be noted, however, that even a detailed explanation of the physical changes of the product is an oversimplification of a complex process.

The finished pellets are screened and placed on conveyor pallets each having grate bars at its bottom that holds the pellets as they travel through the furnace. The pellets are placed gently on the pallet grate bars to form a level bed of pellets at a depth that has been established through practical experience. The depth is usually about 15 inches or more in thickness. Quite frequently, a layer of recently fired pellets is first placed upon the grate bars to form a layer of fired pellets about 3 inches thick. The fired pellet layer is called a hearth layer. Each pallet is part of an endless track conveyor about 300 feet long and often 8 to 12 feet wide. One common conveyor is called a traveling grate machine. The conveyor is part of and contained for the most part within the drying, firing magnetite conversion and cooling zones of a furnace.

There are zones or sections of the furnace named to describe the process that occurs in each zone of the furnace. Generally, the first zone of a travelling grate furnace is the updraft-drying zone. The present invention is used in this section of the furnace, as well as the next zone called the downdraft-drying zone (DDZ).

As an example, consider that a hearth layer of fired pellets 3 inches deep is placed upon the pallet grate bars. A layer of finished pellets 15 inches deep is then placed upon the hearth layer, making a total depth of 18 inches. The hearth layer is dry and the pellets in the finished pellet layer contain 10% water. The grate bars are aligned on the pallet to provide openings about ¼ inch wide to permit hot air to flow through the openings.

The updraft-drying zone of the furnace consist of windboxes beneath the travelling grates. Each windbox is designed to provide a reasonably airtight seal to force air under pressure up through the bed of pellets that is on the travelling grate.

A large quantity of air is directed up through both the hearth layer and the layer of finished pellets. The air temperature is generally 600° F. to 850° F. This description applies to a continuously travelling grate machine that is in equilibrium for temperature and airflow. As an example, consider an 8-ft. wide by 8-ft. long windbox. Assuming the grates travel 96 inches a minute, any pellets are above a windbox for one minute. Hot air is forced up through the pellet bed by a forced draft fan. Sufficient upward velocity and static pressure is maintained to establish an upward airflow. The hot air blowing by the finished pellets evaporates surface water while water inside the pellets slowly evaporates. Some of the heat energy warms the pellets, but most of the heat is used to evaporate water on and within the pellets. The heating and evaporation proceeds from the bottom up through the pellet bed. The transfer of heat travels slowly up through the pellet bed. The evaporation of water cools the air by an amount of energy called the heat of vaporization. The heat transferred to solid masses such as the pallet frames and the hearth layer is called sensible heat transfer.

It is necessary to understand some of these physical changes to evaluate the potential attributes of my invention. Moist air travelling up through a bed of cold pellets is eventually cooled to the dewpoint temperature so that water vapor condenses on the cool pellets, thereby increasing the water content of the pellets. Air travelling up through the pellet bed also carries moisture entirely through the pellet bed. The amount of water removed is consistent with the moisture carrying capacity of the air. The amount of water vapor present is the 100% relative humidity value for the temperature that the air leaves the pellet bed. Water vapor removed in this manner is the primary way that water is removed from the pellet bed. Some of the water evaporated from the lower half of the pellet bed is, however, merely transferred by the condensing action to the cooler pellets in the upper portion of the pellet bed. The pellets on the top of the pellet bed increase in water content by the condensing of water vapor upon their surface so that pellets that originally had less than 10%, now will contain over 12% water, mainly on the surface of each pellet.

The volume of water removed in the updraft-drying zone (UDZ) of the furnace probably exceeds 40 gallons of water per minute. The water removed passes through the top of the pellet bed as water vapor. Forty gallons per minute corresponds to 50% of the water contained in pellets entering the drying zone at a rate of 200 tons per hour.

The cooler pellets near the top of the pellet bed are at the dewpoint temperature. These pellets help control and establish the dewpoint of the moist air travelling upward through the bed of pellets. Essentially the 40 gallons of water removed as water vapor came from the lower section of the pellet bed.

At the end of the UDZ, the pellets at the bottom of the pellet bed are at the temperature and water content correct for the next stage of the firing process prior to the actual firing process. However, in the sequence being described they will not be fired until the end of the firing sequence. At the end of the UDZ the pellets in the top 4 inches of the pellet bed still are wet (over 10% water) and these are the pellets that are to be fired in the final zone, the downdraft firing zone (DFZ) because the DFZ fires the top of the pellet bed first. Following the UDZ is the downdraft drying zone (DDZ) in which the air direction is down onto the pellet bed. The top pellets entering this zone are wet with a water content exceeding 10%. For a depth of five or six inches, the pellets are wetter than when they were initially placed on the pallets. The thrust of air directed upon the pellet bed and the suction of the waste gas fan in the DDZ provide energy to draw air down through the bed of pellets. The pellets are in the downdraft-drying zone of the furnace for only about 2 minutes.

Very little drying takes place in the DDZ of the furnace. This becomes clear when one considers how hard it is to suck air downwardly through 15 inches of pellets, especially when the top 6 inches are wet. Any water that is evaporated expands to steam and artificially increases the volume of gas travelling through the bed of pellets. This is an important factor upon which the present invention is based. The present invention will effectively minimize the problem caused by inadequate drying that occurs in both the updraft and downdraft drying zones of pelletizing furnaces.

Following the DDZ, the pellets enter the downdraft-firing zone (DFZ) with no delay. The temperature in the DFZ is typically 1600° F. to 1800° F. A waste gas fan draws the heated air and combustion gasses through the pellet bed. Pellets that are wet to a depth of about 6 inches from the top of the bed with about 10% water are exposed to hot air (1800° F.) which flows downwardly through that mass of pellets.

The balling drum additives such as bentonite clay, organic binder, limestone or a similar basic oxide present in the pellets provide pathways for water vapor to escape. The limestone is added when fluxed pellets are desired. While probably providing pathways for water vapor removal, it is likely that the limestone will maintain a higher moisture level than what would be present without the limestone. If adequate amounts of additives are not present to provide a pathway for steam to escape the pellets' interior, the pellets may explode and break off part of the outside of the pellet. This unfavorable characteristic is called spalling. With an adequate amount of additive present, however, the water in the pellet is escaping at the time that it would be desirable for oxygen to penetrate to the center of the pellet and begin the conversion of magnetite to hematite reaction. If complete conversion does not take place, a magnetite core results. Magnetite cores can be caused by introducing pellets with too much water into the firing zone of the furnace. The outer layers of the pellets are often sealed through grain growth, thus eliminating the possibility of oxygen reaching the center of the pellet. This is another way that magnetite cores can be produced. The magnetite cores contribute to breakage problems in transportation or inhibit proper blast furnace conversion.

In view of these and other deficiencies, there exists an important need for an improved ore pellet drying process that is not subject to the aforementioned problems and shortcomings.

It is therefore one objective of the present invention to provide an improved ore drying process suited for drying pellets of magnetite, hematite, limonite or other ores in which the pellets have improved strength, abrasion and breakage resistance.

Another object of the invention is to provide fired pellets with the aforesaid advantages which also have optimum moisture content, porosity and resistance to repeated freezing and thawing when fired pellets are produced.

A further object of the invention is to provide an improved ore drying process for hematite, magnetite or limonite wherein a more uniform drying is accomplished throughout all portions of the bed of pellets being dried due to the elimination or reduction of a moisture gradient between the top and bottom surfaces of the pellet bed and to eliminate or reduce the presence of magnetite cores in fired magnetite pellets.

These and other more detailed and specific objects of the present invention will be better understood by reference to the following figures and detailed description which illustrate by way of example of but a few of the various forms of the invention within the scope of the appended claims.

SUMMARY OF THE INVENTION

In the present method of drying iron ore pellets, moisture-containing iron ore pellets are formed into a bed comprising a multiplicity of the pellets. A current of drying gas is forced through the bed of pellets to at least partially dry some of the pellets. At least one jet of a drying gas, e.g. air, is provided above the bed. In one form of the present method oxygen is added to the jet of drying air. The jet of drying gas or air to which $O^2$ has been added is directed downwardly so as to impinge on the upper surface of the bed through which the current of gas rises. The bed of pellets is thus dried with the current of drying gas flowing through the bed as well as the jet of drying gas that contains added oxygen impinging on the upper surface of the bed. Optionally, water can be added if desired to air that is recirculated from one pellet drying zone to another. The term "jet" herein refers to a relatively high speed stream or sheet of gas that is restricted to a specific area. A preferred form of the invention includes a downwardly directed jet of drying gas that is used together with a downward current of drying gas. The present invention also contemplates the possibility of reversing upward and downward flow directions so, for example, in the first stage the current of drying gas could flow downwardly with the counter-current jet being directed upwardly onto the lower surface of the bed. Thus the terms "up" or "down" or "upwardly" or "downwardly" herein indicate directions relative to one another rather than to the earth.

THE FIGURES

DETAILED DESCRIPTION OF THE INVENTION

Figure 1:
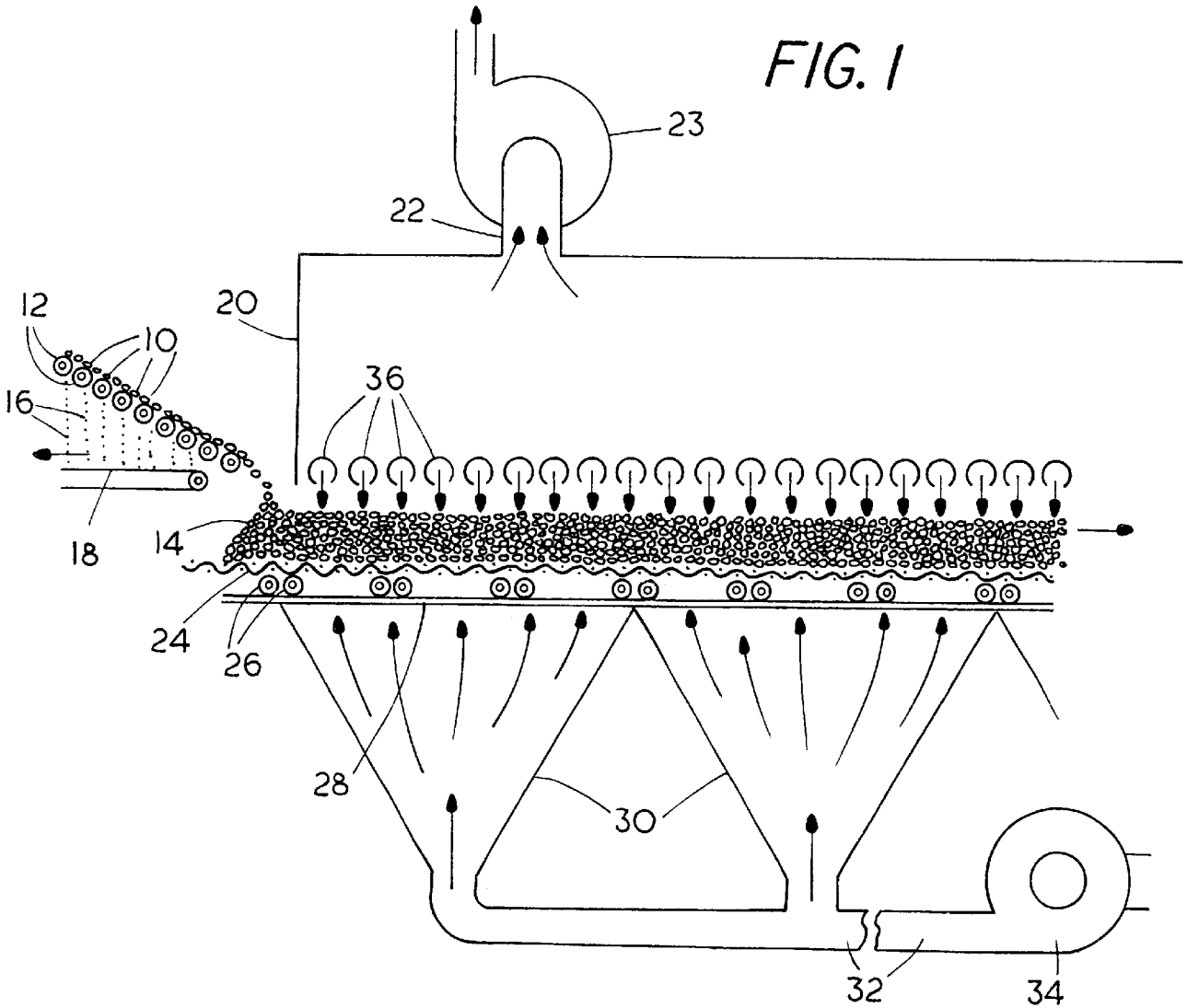
FIG. 1 is a diagrammatic vertical longitudinal sectional view of an apparatus embodying the present invention.

The present invention functions to improve drying at the top of the pellet bed by blowing at least one counter-current jet of hot air downwardly into the pellet bed. The downwardly directed jet impinging against the top of the pellet bed in the updraft drying zone (UDZ) of the furnace has a higher flow velocity than the upward current of air. The jet will thus overcome for an instant the upward movement of air in the air current, but because the upward movement of air is continuous, the downward jetting of air will not interfere with, i.e., stop, the upward movement of air. Each jet of air emerges from a slot typically about 3 inches above the pellet bed. The impingement of the air jet against the pellets has a very noticeable effect compared to the current of air that is drawn through a bed of pellets as will be understood by those skilled in the art. For one thing, it removes the boundary layer of gas at the surfaces of the pellets in the upper layers of the bed.

The following description focuses on the removal of water from the top portion of a pellet bed. The invention is described by way of example, beginning with the first phase of a standard travelling grate furnace in solving some problems that occur in the updraft drying zone (UDZ) of a pelletizing furnace. It will be assumed that the conveyorized furnace has 8-foot wide conveyor pallets and five windboxes 8 feet by 8 feet in the UDZ, for a total drying zone 40 feet long. The pellets are assumed to have a mean diameter of ⅜ inch and a water content of 10%.

The jet action is provided by a series of slotted supply pipes or other type ducting installed across the top of the pellet bed. Above the first windbox, the supply pipes are spaced as close to each other as practical, e.g., three pipes per foot. Each pipe or duct has a ⅜" to ½" wide slot or jet opening extending its entire length. Each slot is on the bottom to enable hot air to be directed downwardly onto the pellet bed. Each pipe is typically about 3 inches above the top of the pellet bed. The distance of the pipe or duct above the pellet bed should not interfere with the conveyor operation.

While the air jets can be directed vertically, in some cases the air is blown downwardly at a slight angle, either into or with the direction of travel of the conveyor in the traveling grate machine. The hot air should travel about 2.5 inches into the bed of pellets with significant force. At about 4 inches into the bed, the jet will have a reduced force or velocity.

At the 4 inch depth it is necessary to warm the surface of a given pellet only a few degrees warmer than it would be without the jet. Warming the surface of a pellet only a few degrees warmer than the upward current of air is, however, highly effective since this is all that is needed to prevent condensation. It should be understood that the upflow of air is controlled by the temperature of the pellets in the area that the air is passing through. However, conductive heat transfer also has a small warming effect on the pellets at the 4-inch depth.

The jet above windbox WB1 blows hot air down into the first two or 3 inches of the pellet bed. The pellets contacted by the hot air jet are then warmed well above the dewpoint temperature. The top pellets then begin to be dried, significantly drier as they become heated on the outside. Water evaporates from the outside and some evaporation begins on the inside of the pellet.

The warming and drying of the top pellets will continue through the entire updraft-drying zone because the counter-current jet will continue to penetrate into the pellet bed. The spacing between the jet supply pipes can be reduced so that they are spaced on about one foot centers or so for the rest of the 40 foot DDZ.

The pellets are warmed by the hot air jets, but cooling of the pellets also occurs when the relatively cool saturated air current flows by the pellets in an upward direction. The consequent cooling of the pellets does not cool them below the dewpoint temperature, but physical water transfer may cause some of the pellets near the bottom (say, the bottom 4-inch layer) to get wet sporadically.

It is assumed that the furnace has adequate hood exhaust fan capacity to handle a significant upward current of air. Each furnace must be evaluated to determine the volume of jetted air needed to dry the top of the pellet bed. Furnaces with lower excess air capacity will use smaller jets and their spacing will be increased. As described more fully below, proper design will permit one to use as much hot-jetted air as required. A greater benefit will result from using more air. In a system with higher air volume, the top 2.5 inches of pellets may be dried to 5% water. In the less aggressive system, the pellets may be dried to about 7% water. In either case, the pellets leaving the updraft-drying zone of the furnace will be significantly drier than what presently exist without the downward jetting of hot air.

In equipment employing the present invention, the resistance to airflow will be reduced for updraft drying. The lower resistance will provide the possibility of increasing the general air current so as to achieve better drying for the pellets below the top 4 inches of the pellet bed. This extra drying will improve the furnace operation.

Better drying of the pellets in the top 4 inches of the pellet bed that is achieved with the present invention will make the final product better because the drier pellets will not have the course rough surface that is caused by being wet due to condensation on the pellets surface. The course rough surface is one of the leading causes of dust in the finished pellets.

The next zone of the furnace is the downdraft-drying zone (DDZ). To improve drying in this zone of the furnace, a current of hot air is blown down into the top of the pellet bed. The slots for the jets are very close to the top of the pellet bed, e.g., 1.5 to 2 inches away. Energy to create the downward velocity of each jet is provided by the static pressure developed by a fan. The volume of air jetted down onto the top of the pellet bed is designed to balance the amount of air exhausted by the waste gas fan connected to the windboxes in the DDZ. The waste gas fan provides negative suction to assist in drawing the jetted air through the pellet bed. All the air is travelling from the top of the pellet bed and down to the bottom of the pellet bed. For this reason the volume of air that is jetted down onto the bed will be adjusted to slightly exceed the volume of air in the current entering the hood over the DDZ.

Most of the surface water was removed in the updraft-drying zone of the furnace by using counter-current downward jetting of hot air. However, in the downdraft drying section of the furnace most of the benefit will be in heating the pellets in the top 4 inches of the pellet bed. The removal of water is achieved by raising the temperature of the top 4 inches significantly above the boiling temperature of water. Additionally, water of hydration is also removed at temperature above 212° F. Additional drying is accomplished on the pellets below the 4-inch depth because the air is hot when it first penetrates to that depth.

A plurality of narrow slots preferably provide the downwardly directed air jets. Some or all of the slots can direct air jets at a slight angle into the movement of the travelling grate machine, and some can be used to direct the air with the movement of the travelling grate machine. However most of the slots will direct the air jets vertically into the pellet bed. The slots are typically about one-quarter to three-eighths inch wide. The jet velocity is about 2000 feet per minute to 3000 feet per minute at a temperature of about 800° F. The slot width and air velocity can, however, be changed depending upon the design specifications encountered.

Prior to final installation of the jet supply pipes, the volume of air exhausted by the hood exhaust fan and the waste gas fan is measured. Airflow of specific ductwork should also be measured to engineer the proper air balance.

The benefit of drying the top of the pellet bed can be appreciated when it is recognized that the prior system in use introduced pellets into the firing zone of the furnace with a water content of nearly 10% for the top 4 inches of the pellet bed. When the invention is used in the first two drying zones, the top 4 inches of the pellet bed entering the downdraft firing zone will have a water content as low as 4% which results in a significant improvement in the quality of the pellets produced. Increased furnace capacity in tons per hour is another important benefit.

A firebrick wall a few feet thick usually separates the downdraft-drying zone (DDZ) from the downdraft-firing zone (DFZ). Hot air jets according to the present invention are also provided in the area below the brickwork. This additional jetting is directed into the travelling movement of the pallets, i.e., by directing the jets slightly upstream. This will dry the pellets slightly more before they enter the firing zone.

Refer now to the drawings which illustrate by way of example a preferred mode of practicing the present invention, for example in drying magnetite pellets.

As shown in FIG. 1, green, freshly-formed pellets 10 are carried downwardly from left to right on a roller feeder screen indicated diagrammatically at 12 to a drying bed 14 which is typically about 15–18 inches thick. Fines 16 fall from the feeder screen 12 onto a conveyor 18 and are carried back to the pelletizer for reprocessing. Positioned over the bed 14 is a drying hood 20 having an outlet duct 22 that is connected to an exhaust fan 23 for drawing gas upwardly as indicated by arrows. The bed 14 of pellets 10 is typically supported on an endless conveyor screen, e.g., a pallet-style conveyor 24 that is connected to supporting rollers 26 which ride on longitudinally extending rails 28 so as to carry the bed 14 from left to right in the figures at a slow rate, e.g., eight feet per minute. Below the bed 14 and communicating with the bed 14 through the supporting conveyor 24 are a plurality of transversely extending, longitudinally distributed windboxes 30 beginning with number 1 in FIG. 3 proceeding from left to right, to which drying air is supplied to a duct 32 which communicates with a blower 34 for forcing the air into the windboxes 30 so as to blow a current of heated drying air upwardly through windboxes 1–5, thence through the portion of the bed 14 above each successive windbox 30 to at least partially dry the pellets 10 in the bed 14. Moisture-containing drying air is removed from the hood 20 through the exhaust outlet 22. Such a furnace is referred to as a "traveling grate furnace." In such a furnace, iron ore pellets are distributed across the width of grate pallets which make up the conveyor 24. The trip through the dryer usually lasts about five minutes. Previous to the present invention, the top of the pellet bed 14 had about six inches of wet pellets.

Figure 2:
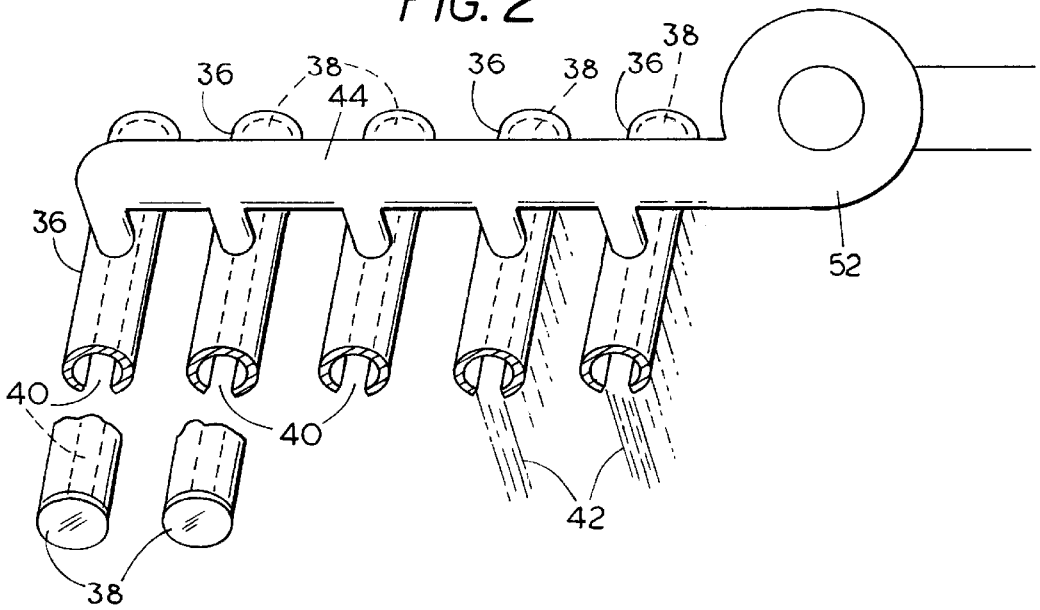
FIG. 2 is a diagrammatic perspective view showing pipes for providing counter-current drying gas jets in accordance with the present invention.

Refer now to FIG. 2. Positioned above the bed 14 and spaced apart from the bed a short distance, typically from about two to four inches, are a plurality of laterally extending, horizontally disposed drying gas supply pipes or ducts 36, each of which is closed on each end by means of end walls 38. Each pipe 36 is provided with a downwardly opening slot 40, typically from about one-quarter inch to about one and one-half inches in width. The slot is typically about one-half inch wide for a supply pipe 36 that is about five to eight inches in diameter. Each slot produces a downwardly directed sheet-like jet of drying gas 42 (FIG. 2) that impinges on the upper surface of the bed 14 of pellets 10. Drying air heated to about 800° F. is supplied to the pipes 36 via a supply pipe 44 from a blower 152.

Figure 4:
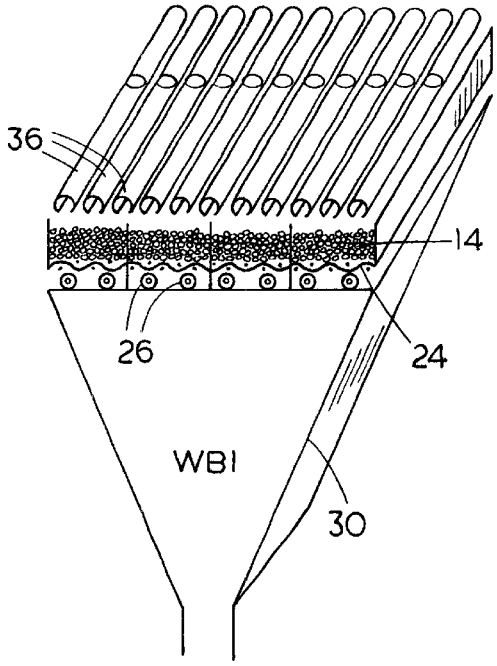
FIG. 4 is a diagrammatic perspective view of a portion of FIG. 3 on a larger scale.
Figure 3:
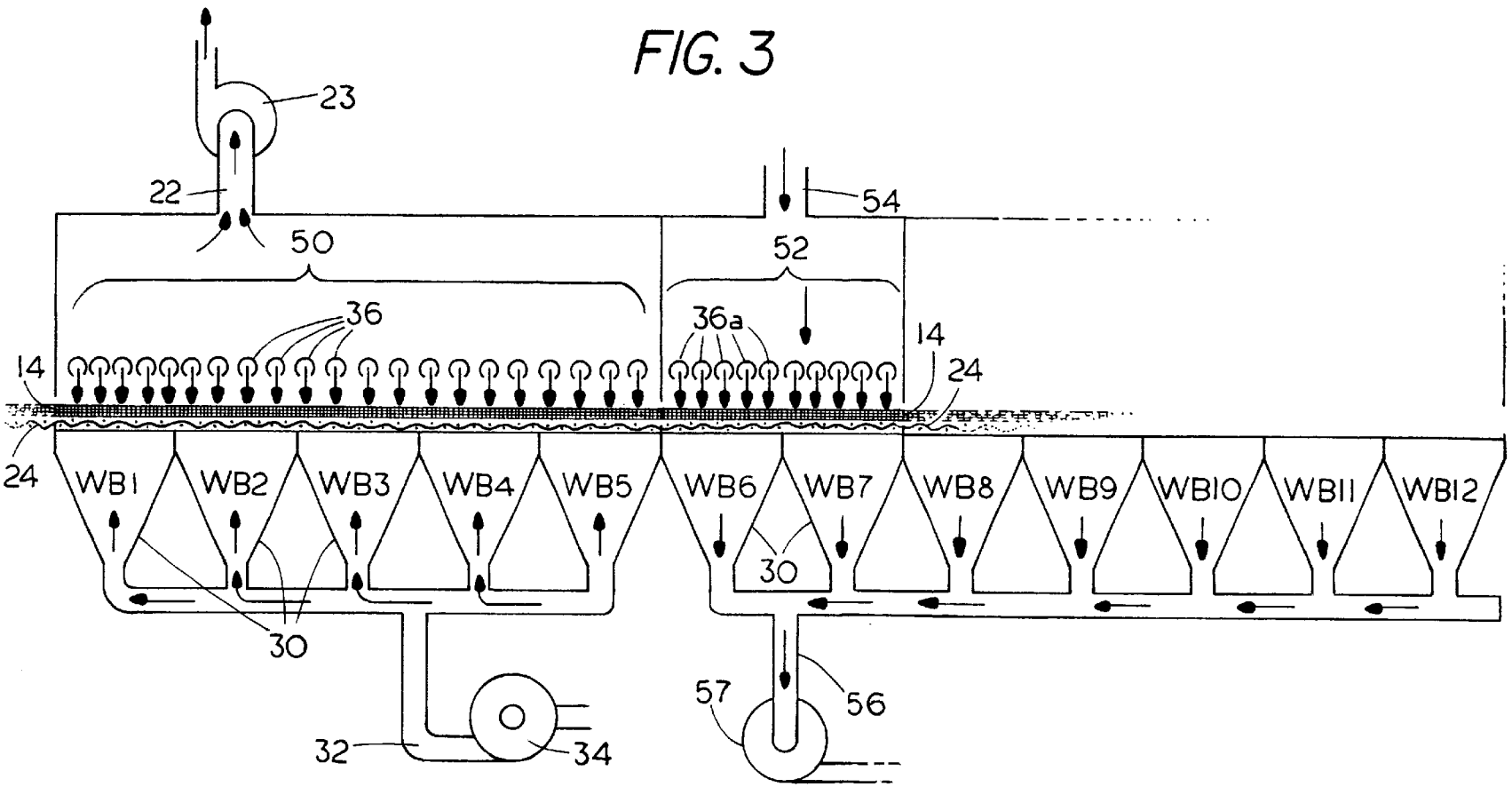
FIG. 3 is a diagrammatic longitudinal vertical cross-sectional view showing successive drying stages in accordance with the present invention.

As shown in FIGS. 3 and 4, typically a plurality of windboxes, e.g. five, (WB1–WB5) are provided in a hooded exhaust updraft drying section 50. While the width of the drying bed can vary, it is typically about eight feet wide and consequently the drying pipes 36 are each about eight feet long. The drying air passing through pipe 44 (FIG. 2) is supplied at a rate sufficient to produce a slot velocity of about, say, 3000 feet per minute in the jet 42 as it leaves the slot 40. Typically, each eight-foot drying air supply pipe 36 will discharge about 1000 cubic feet per minute of hot drying air. The slot width, the discharge velocity and the cross-sectional shape of the pipes 36 can be changed as desired. The pipes 36 can be round, rectangular, oval or of other shapes best suited to the requirements of the fabricator.

After the bed 14 has passed the last windbox WB5 of the exhaust hood section 50, it enters a downdraft unfired drying zone, i.e., the DDZ 52 (FIG. 3) which is supplied with heated air via duct 54 at a temperature of, say, 800° F. traveling downwardly through the bed 14 thence through windboxes WB6 and WB7 and out through exhaust duct 56 to further dry the pellets 10 in the bed 14.

In FIG. 4 is shown a typical windbox which may be about eight feet wide and about eight feet long as seen in plan view. As shown in FIG. 4, four individual pallets comprising portions of a conveyor cover one windbox. The rate of travel of the conveyor is usually about eight feet per minute; thus, any individual pellet is above a windbox for about one minute.

Figure 5:
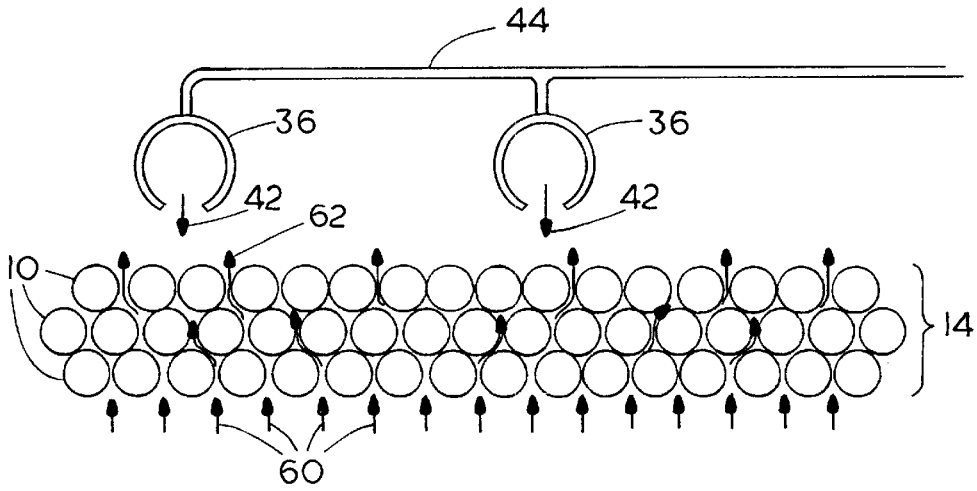
FIG. 5 is a diagrammatic longitudinal sectional view on a larger scale showing the flow of gas during the first stage of drying.

Refer now to FIG. 5 which illustrates diagrammatically the drying in the bed 14 during the initial drying stages above one of the windboxes WB1–WB5 which carry air upwardly through the bed 14. As shown in FIG. 5, a current of heated air 60 flows upwardly through the bed 14 around and between the pellets 10 and is exhausted from between the pellets 10 in the bed 14 as shown at 62. Simultaneously, the jets 42 of hot counter-current drying gas are forced down-wardly from the supply pipes 36 and impinge on the upper surface of the bed 14. The downwardly directed jets 42 are effective in further drying the upper layer of pellets 10, particularly the first two to three inches from the top surface of the bed 14 since the upwardly traveling current of air 40 is heavily laden with moisture. While no dramatic increase of pellet temperature is achieved by any particular downwardly directed jet 42, each one-half inch wide jet or sheet of air at 800° F. will have pellets exposed to it and under its influence for about one second. After about one second of heating by the jets, the pellets thus heated will be exposed to cooler air 62 from the upward current of drying air 40 for about 15 seconds, thereby removing some of the heat from each of the pellets heated by the jet 42. Thus, while no particular jet 42 by itself produces a dramatic increase in pellet temperature, it is important to recognize that the jets 42 keep the top layer, say, the top two or three inches of pellets, above the dewpoint temperature of the surrounding drying gas. Thus, the hot air jets in the updraft section 50 minimize condensation that would otherwise occur on the pellets 10 without the jets.

Figure 6:
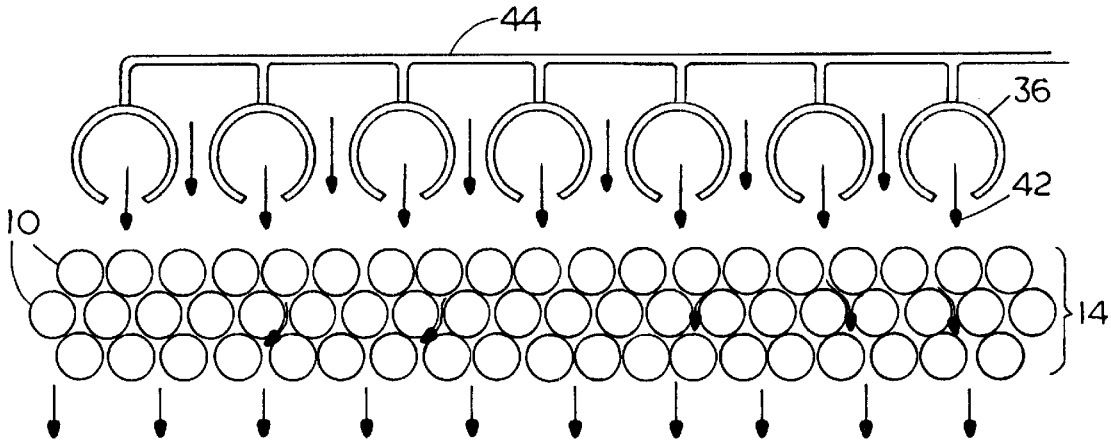
FIG. 6 is a view similar to FIG. 5 showing the flow of drying gas in a subsequent stage of drying.

Refer now to FIG. 6 which illustrates the benefits that are achieved when the pellets 10 enter the unfired downdraft drying zone 52 of FIG. 3. In this section, suction provided by a waste gas fan 57 (FIG. 3) draws waste gas at a temperature of, say, 800° F. downwardly through the bed 14 from the inlet 54. Inlet 54 supplies hot air under pressure to drying zone 52. The hot air supply pipes 36*a* in the downdraft drying section 52 provide momentum to each air jet, forcing air more effectively through the top two or three inches of the pellet bed 14. Significant added drying therefore occurs. The pellets 10 are in the downdraft drying section 52 typically for about two minutes. The very uppermost layer of pellets, say the top one inch of pellets 10 in the bed 14, are usually dried to about 3% by weight water which is located mainly in the center portion of each pellet 10.

Figure 7:
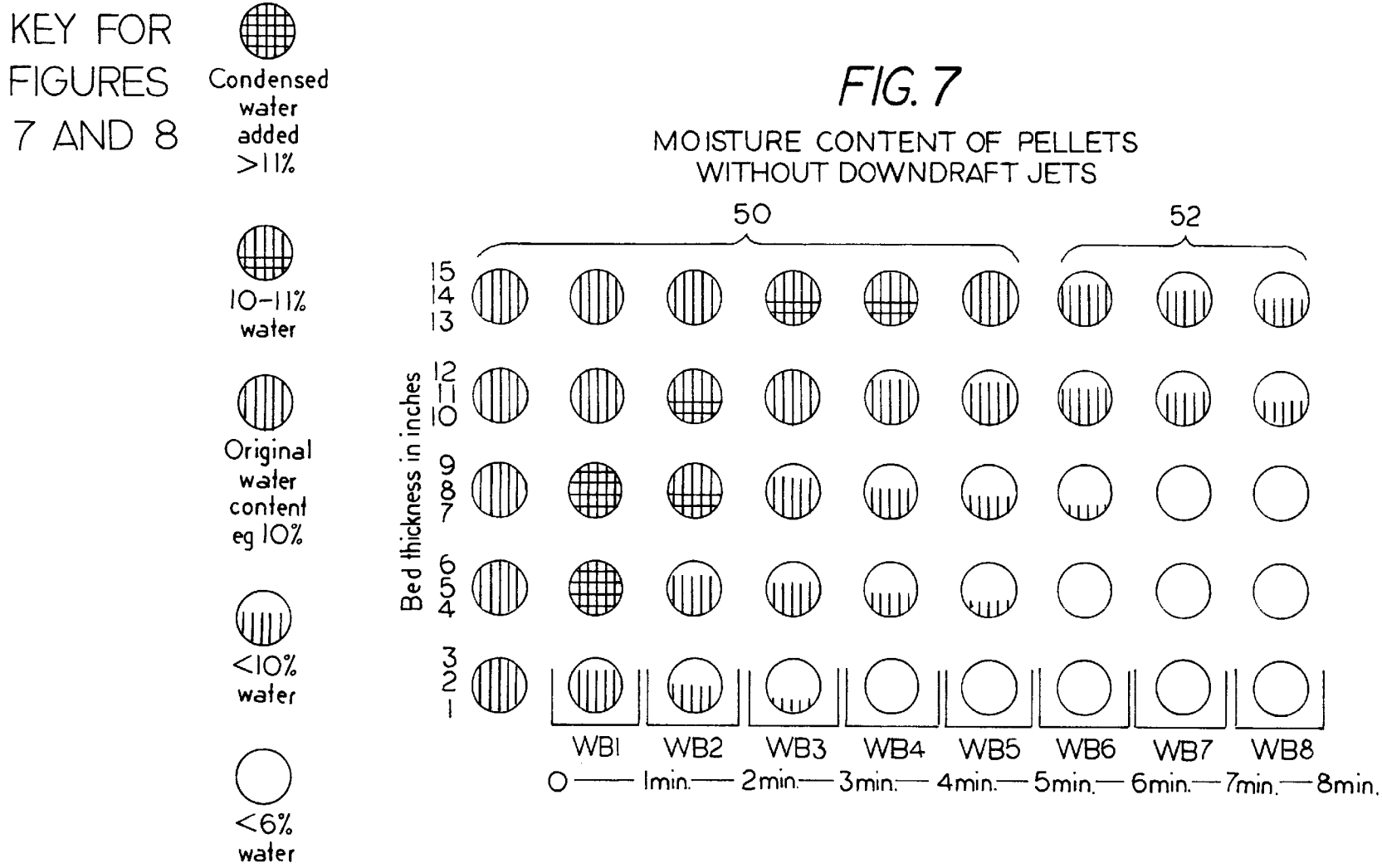
FIG. 7 is a diagram depicting the moisture content of the pellets without the downdraft jets of the present invention.
Figure 8:
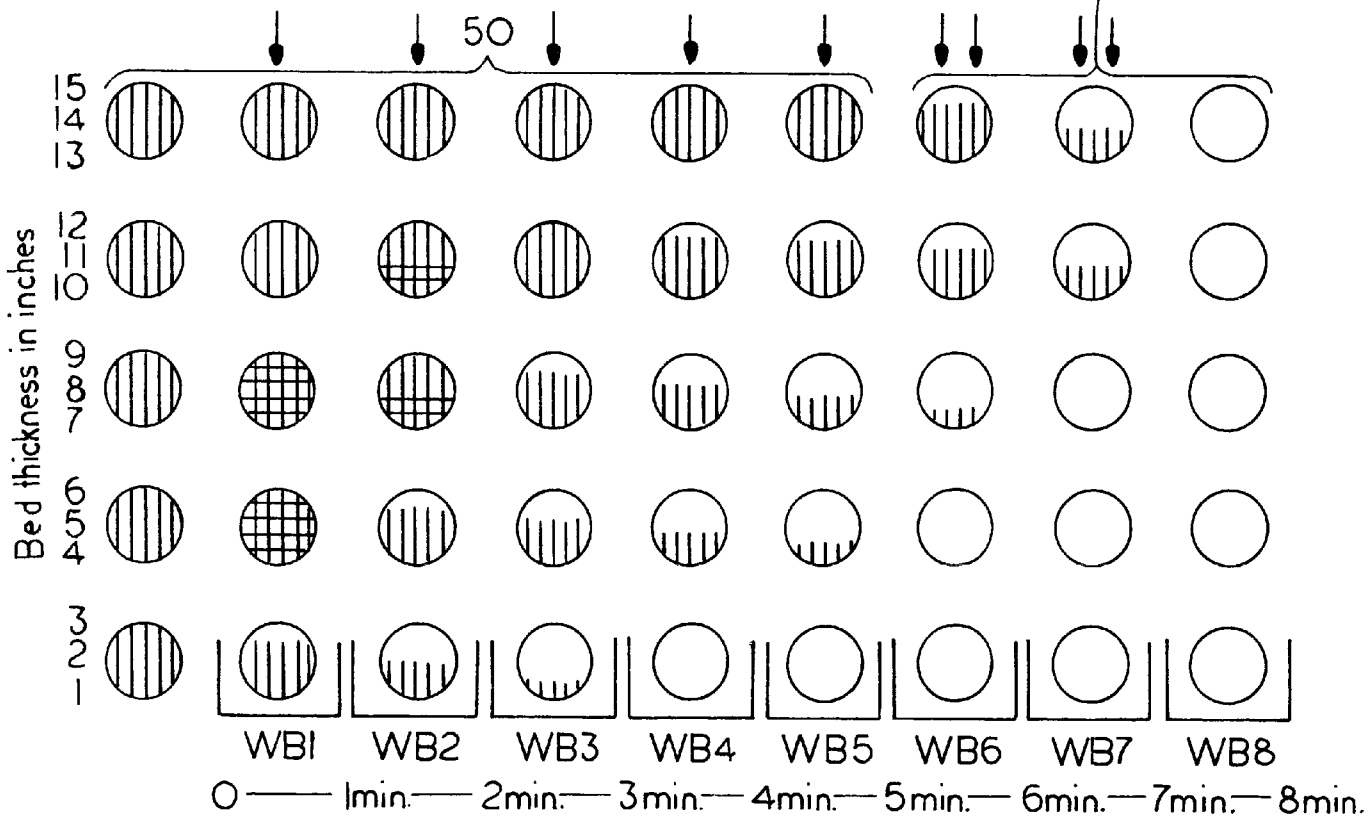
FIG. 8 is a diagram similar to FIG. 7 but depicting the moisture content of the pellets with the downdraft jets of the present invention.

Refer now to FIGS. 7 and 8 which illustrate moisture content of the pellets 10 above various windboxes without the downdraft jetting (FIG. 7) and with downdraft jetting (FIG. 8). In windbox WB1, after about one minute with an 800° F. upward current of air, the bottom pellet is dried on the surface while the inside is still wet. The estimated water content is about 8% for about 1–3 inches from the bottom of the bed 14, while the water content at the 4–9 inch level is even greater at about 11% to 12% on average. In FIG. 8 showing the invention, the moisture content of the pellets 10 in WB1 will be about the same as in FIG. 7.

In windbox WB2, without the invention (FIG. 7), the estimated water content will be about 5%, but in the invention (FIG. 8) some water has been removed in the 1–3 inch level. In FIG. 8 at the 4–6 inch level, the water content will be about 8%; at the 7–13 inch level it will be about 12%, and the top inch of pellets may have about a 9% water content. Pellets in the top three inches will be warmed above the dewpoint of the drying air.

In windbox WB3, without the invention (FIG. 7) the estimated water content will vary from about 2% in the 1–3 inch levels and about 12% in the 13–15 inch levels. WB3 in FIG. 8 using the invention will be about the same, with the top layer of pellets back to their original 10% moisture content. The added water does not come from condensation but from physical movement of the water.

In windbox WB4, after four minutes of treatment, the bottom zone is nearly dry in FIG. 7 and at successively higher levels varies from 3% to 11%. In windbox WB4 of the invention (FIG. 8) moisture contents are the same except for the top zone which is only 9%, thus showing the benefit of the present invention.

After five minutes without the invention, the 1–3 inch levels are dry in windbox WB5 and moisture increases up to the 13–15 inch level which is about 10%. By contrast, with the invention in windbox WB5 the top 15-inch level is only about 7% to 8% water and therefore appears dry.

Without the invention (FIG. 7), after one minute of downdraft in windbox WB6, the bottom levels remain the same. At the 13–15 inch level, moisture content is about 8% and in the 10–12 inch level, the moisture content is 7%. In the invention by contrast (FIG. 8), the moisture content at the 13–15 inch level is only 6% and that drops to 4% in windbox WB7 and to a very low level, about 3% or below in windbox WB8. By contrast, in windbox WB7 after two minutes without the invention (FIG. 7), the 13–15 inch level is 7% and at 10–12 inches is about 6% moisture.

Assume that the bed 14 travels into the downdraft-firing zone WB8–WB12 without the invention. In windbox WB8 after one-minute exposure to a downdraft at about 1600° F., the 13–15 inch level would still be at about 6% moisture, too wet for good firing.

Figure 9:
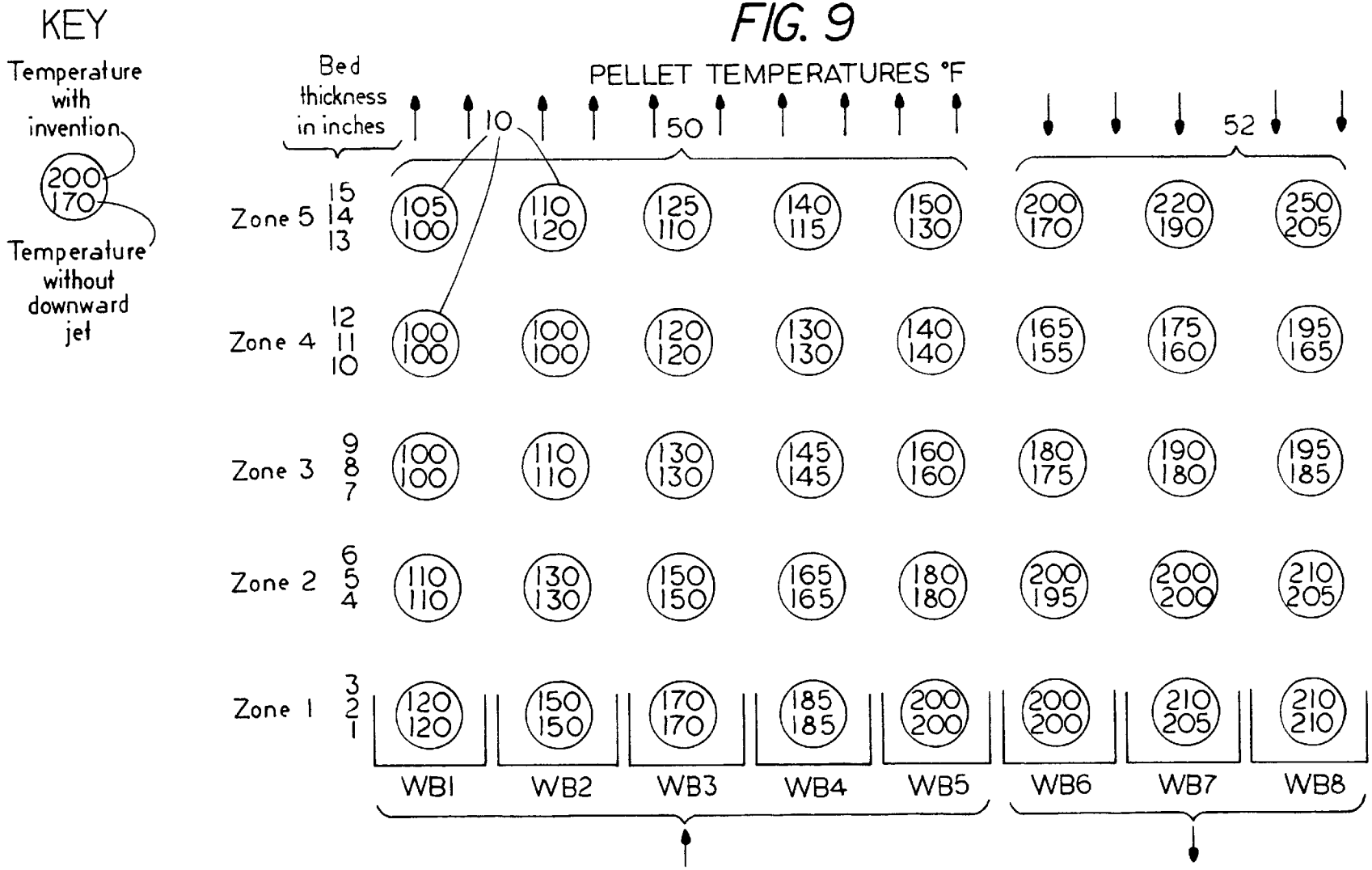
FIG. 9 is a diagrammatic depiction of the temperature of the pellets with and without the invention at different levels in the bed.

Refer now to FIG. 9 which illustrates the temperature of the pellets 10 at various bed thickness levels in the different windbox areas. It will be noted that the temperature achieved with the invention (shown at the top of each pellet) is generally higher than that of the prior art (shown at the bottom of each pellet), particularly in the upper levels, e.g. zones 4 and 5 of the bed 14. It will also be noted that the invention achieves a pellet temperature of 250° F. in zone 5 of WB5. By contrast, a temperature of only 205° F. is achieved in zone 5 without the jets 42. In zone 4, the invention achieves a temperature of 195° F. compared with 165° F. without the downwardly directed jets 42. The pellet temperatures of the invention in zones 3 and 2 in the last windbox WB8 is also higher than without the invention. Thus, the average temperature of the pellets 10 in most zones of the pellet bed 14 is higher using the invention. While the temperature increases due to the hot air jets 42 in accordance with the invention are not dramatic, the invention provides a critical advantage by keeping the top few inches of the pellet bed 14 above the dewpoint while in the updraft drying zone 50. An important temperature improvement is also achieved by the present invention in the downdraft-drying zone 52 of the furnace.

Figure 10:
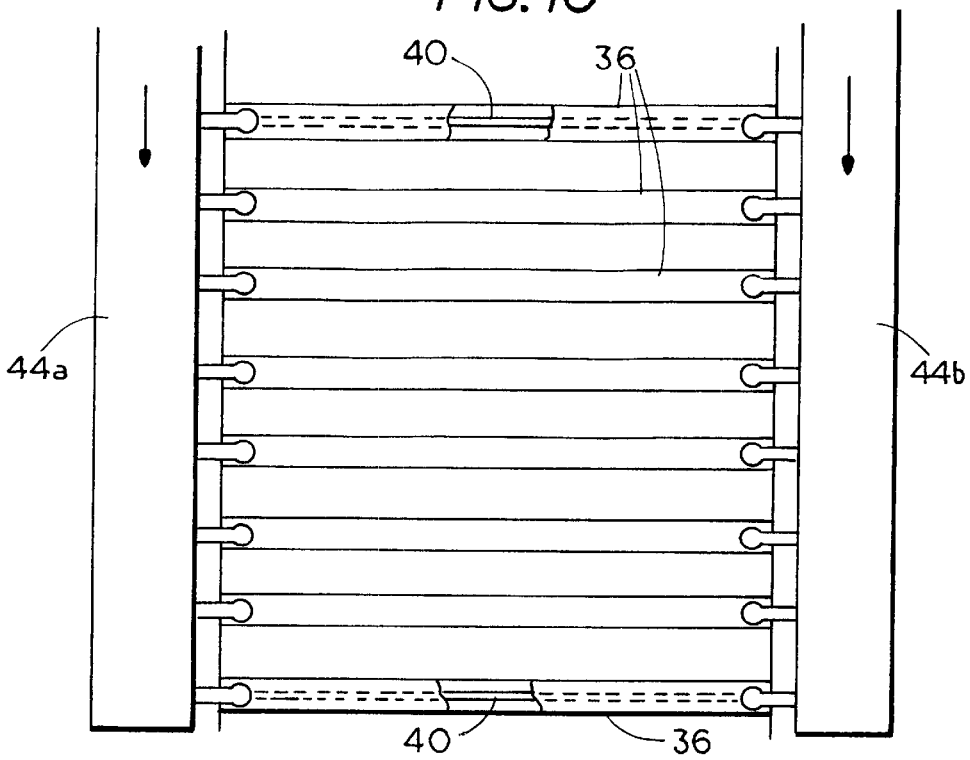
FIG. 10 is a diagrammatic plan view partly in section showing how air is piped to the air jets in accordance with one form of the invention.
Figure 11:
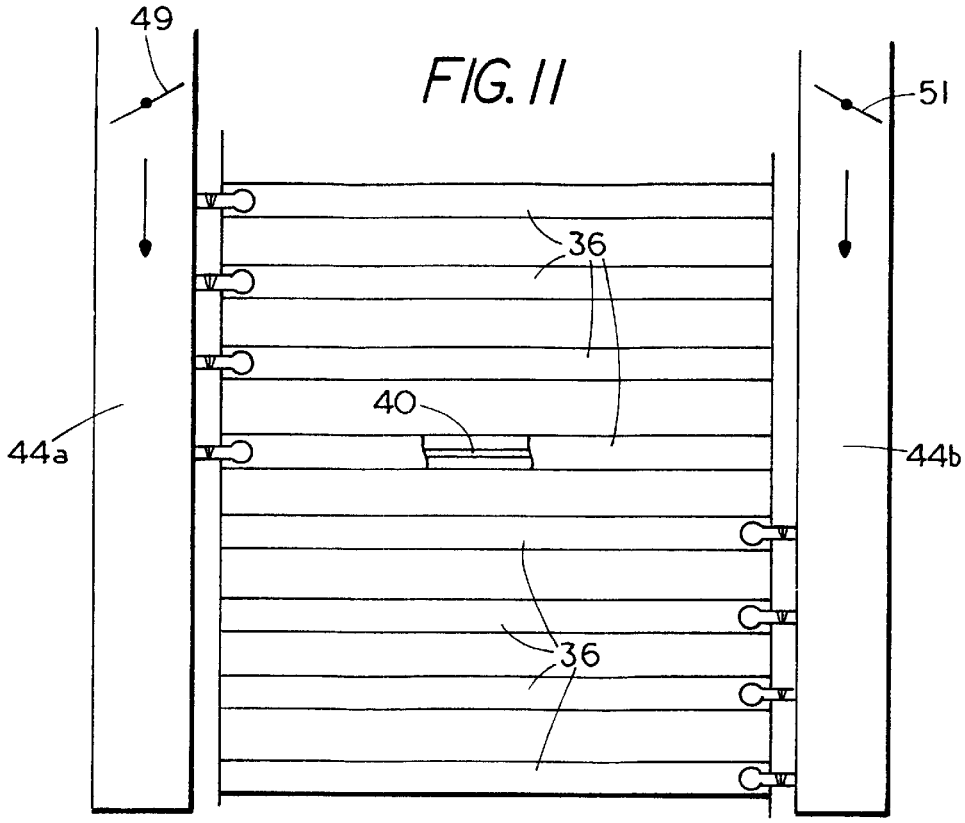
FIG. 11 is a view similar to FIG. 10 showing how air can be piped to the jets in accordance with another embodiment of the invention.

Refer now to FIGS. 10 and 11 wherein the same numerals refer to corresponding parts already described. In FIG. 10, the heated drying air supplied to the pipes 36 is provided by means of a pair of supply ducts 44*a* and 44*b* connected to opposite ends of the pipes 36 to assure equal distribution of hot air that is forced downwardly through the slots 40 to provide the downwardly directed sheet-like currents of air 42 (FIG. 2). The ducts 44*a* and 44*b* can be used to assure that an equal air supply is provided to each end of the distribution pipes 36. In the alternative, a single supply duct 44*a* can be provided with equal distribution achieved through dampers or blast gates (not shown) within the distribution pipes 36.

In FIG. 11, hot air is supplied to four distribution pipes 36 at the top of the figure by the supply duct 44*a* at the left and to the remaining distribution pipes 36 are supplied by the supply duct 44*b* at the right. Thus, in this case, the hot air which may be supplied from a suitable furnace location via a blower (not shown) is introduced to opposite ends of different ones of the distribution pipes 36 so that any differences at opposite ends of a given pipe, as well as different temperatures in the duct 44*a* versus duct 44*b* will cancel out after all of the pellets have passed the distribution pipes 36. Any one side of the furnace should not be supplied by significantly more air (say, more than 25%) than the other side. Balancing in FIG. 11 can also be assisted by the use of dampers such as dampers 49 and 51.

Pellet Drying Mechanism

In the updraft drying zone, water is first removed from the surface of the pellet and from a thin layer of the concentrate on the outside of the pellet. This drying occurs before the hot air is saturated with water vapor. The evaporation of water, however, lowers the temperature of the air consistent with the heat of vaporization of water. The air temperature is also lowered slightly due to sensible heat transfer.

When the saturated air comes in contact with cold pellets above those that were being dried, water condenses on the colder pellets. The condensing action warms the pellets significantly, but because in the beginning there is an abundance of cold pellets, most of the water is condensed before the air reaches the top of the pellet bed. This is particularly true if one considers the progression through the drying zone as occurring in one-minute increments as described in the earlier drawings.

The evaporation and condensing occur for the entire five-minute drying zone. Some of the less obvious characteristics of pellets should be understood to appreciate the advantages achieved during the drying of pellets. Some of the mechanisms of pellet drying will therefore be explained in more detail.

The surfaces of pellets are initially moist so that when hot air is forced up and around a pellet, the surface water and some of the water in a thin layer of pellet material is evaporated. When this occurs, some heat is transferred by water into the center of the pellet because water conducts heat fairly well. The water in the center of the pellet is warmed to a temperature below the boiling point of water, but probably near 150° F. in some instances. After the surface water leaves the pellet, there is significantly lower transfer of heat into the center of the pellet because the finely ground particles do not transfer heat efficiently due to little surface-to-surface particle contact. This may first appear to be a problem, but careful consideration will show that it provides advantages in drying taconite pellets. Updraft drying is actually improved because most of the bottom pellets have the surface water removed from the bottom of the pellet bed, then very little heat transfer takes place at that level and the hot air contacts the next upper layer of pellets. The same mechanism takes place on subsequent upper layers of pellets. The pellets near the top of the bed are not adequately dried due to furnace tonnage requirements, but the top pellets are warmed to about 180° F. for most operations.

The hot air jets 42 warm the surface of the top two inches of the pellet bed above the dewpoint temperature. The combination of the warm updraft drying air plus the hot air jets 42 result in a dry surface on the pellet including a thin layer of dried concentrate on the surface of the pellet. The pellets that leave the updraft drying zone that were also heated by the hot air jets 42 enter the downdraft drying zone of the furnace hot and dry enough to benefit from the hot air jets in that section of the furnace.

The top few inches of pellets entering the downdraft-drying zone are heated continually for the next two minutes with the hot air jets forcing air down into the bed of pellets. The normal furnace drafting will continue to draw the hot air through the pellet bed. The top few inches of pellets are dried much better because of the hot air jets. The slow transfer of heat described earlier still exists, but water is removed from the center pellet faster with the addition of the hot air jets. The pellets leaving the downdraft-drying zone are thus heated well above the boiling temperature of water. While some water may still be bound hydroscopically to the binders or other additives, most the water will be removed.

In the downdraft firing zone of the furnace, the air temperature is high enough, e.g., 1800° F., to start oxidizing the top pellets. The oxidation will be slow because of the slow transfer of heat described earlier (due to small irregularly shaped particles) and also because of the low oxygen content of the air. Slow oxidation may prove to be a benefit because there is a minute or two available to permit the heat from oxidation to remove all the water from the center of the pellet, which is an important advantage since water in the center of pellets retards oxidation and results in the magnetite core in the center of pellets. This dissimilar material is the main reason that pellets have a lower than desired compression test.

With no hot air jets, some pellets leave the updraft-drying zone 50 saturated with water. When the pellets reach the downdraft-drying zone, the hot air does not penetrate the layers of wet pellets. The hot downdraft drying air evaporates the surface moisture is cooled by the heat of vaporization. Further drying is slowed and, as a result, when the pellets leave the downdraft-drying zone they have a center that has about 5% water. The hot gases in the downdraft-firing zone begin the oxidation of the magnetite pellet. The oxidation is severely retarded by the water in the center of the pellet. The water that is evaporated prevents heat transfer and oxygen transfer. The result will be pellets with magnetite cores and a low compression test rating. The present invention drastically reduces or eliminates all of these problems.

The invention will thus heat and dry the pellets more effectively and more uniformly than the prior art. It can be seen that an important advantage of the invention derives from heating the pellets on the top two or three inches of the pellet bed 14, since those are the pellets that have the poorest quality. The fact that the top pellets stay wet is one of the factors that produces pellets of lower quality. Another factor is that pellets were heretofore fired in a low oxygen atmosphere because oxygen is consumed in raising the air temperature to about 1800° F. and later to about 2400° F. in the firing zone (windboxes WB8 and above). Preliminary calculations indicate that the distribution pipes 36, while they can be of various sizes should have a diameter of about eight inches for a one-half inch slot 40. However, with a smaller distribution pipe of, say, four to five inches in diameter, dampers and baffles can be installed as will be apparent to those skilled in the art to achieve an approximate equal volume of air blowing out through all of the slots 40. It should be understood that the distribution of air does not have to balanced perfectly and, as shown in FIGS. 10 and 11, balancing can be accomplished by feeding air to opposite ends of the distribution pipes 36 rather than to the center (FIG. 4).

An important advantage of the present invention is its adaptability for use in existing pellet drying equipment, that is, as an after-market unit to be installed in equipment now in use. Other benefits of the present invention will be better understood when one considers that for each 200 tons of product produced with 10% water, there is an input of 220 tons of material. Because of the spherical shape of the pellets and the water present, the density of the pellets is about two or slightly less. Therefore, a cubic foot of pellets weighs about 100 pounds. Two hundred twenty tons per hour is 3.7 tons per minute, or 7,330 pounds per minute, i.e., 73 cubic feet per minute. On a machine eight feet wide with a bed 15 inches deep, the machine would have to move 7.3 feet, or about 90 inches a minute to maintain a steady operating production rate. This volume of material shows that even a small reduction in moisture has far-reaching benefits.

It has been observed that moisture condenses inside the exhaust hood in some prior art installations. Moisture can and does also condense on cold pellets. The present invention reduces both of these conditions and in that way improves the final product.

Thus, the present invention enhances drying by using the downward jets 42 of hot air impinging on the top layer of the pellets to heat the top layer of pellets above their dewpoint temperature so the pellets are dryer on the top of the pellet bed 14 from the drying in the updraft zone 50. The downward jets in the downdraft-drying zone will dry the pellets in the downdraft zone 52 at least three or four inches deep into the pellet bed 14. The pellets 10 typically pass through this zone of the furnace in two minutes and are much drier leaving the downdraft zone 52 than they would be without the present invention. In the final zone of the furnace, the downdraft drying fired zone (windbox WB8 and higher) the pellets are heated to about 1800° F. Because of the improved drying made possible by the present invention in zones 50 and 52, improved firing can be achieved without damaging the pellets.

Additional features of the invention will now be described with reference to FIGS. 12–15 wherein the same numerals refer to corresponding parts already described.

A typical prior traveling grate furnace has seven windboxes dedicated to drying magnetite pellets and five windboxes dedicated to firing the pellets. These furnaces may have about eight feet of firebricks in a wall 100 at the end of the firing zone that separates the firing zone 102 from the heat recovery zone 104 of the furnace. The firing zone 102 is often heated to 2400° F. in the ignition zone of the furnace. The firebricks in wall 100 used to separate the ignition zone 102 from the heat recovery zone 104 are heated to 2400° F. on the furnace side and about 850° F. to 1100° F. on the heat recovery zone of the furnace.

Operating characteristics of a furnace can be analyzed by conducting tests using thermocouples to measure the temperature at established pellet depths throughout the various zones of the furnace. One measurement of interest is the temperature two inches below the top of the pellet bed. It should be noted that thermocouples indicate the air temperature moving through that area of the pellet bed, the radiant heat from the hot pellets, particularly while the pellets are being oxidized, and often surface contact between the thermocouple and the hot pellets. These sensing variables must be considered when evaluating temperature measurements using a thermocouple. With these limits in mind, a thermocouple test provides very useful data for the evaluation of a production furnace used for firing magnetite pellets in the taconite industry.

Considering the top two inches of the pellet bed 14, a thermocouple temperature measurement indicates a very low temperature increase in prior art furnaces updraft drying zone (UDZ) 50. The same thermocouple position indicates temperatures (hot air temperatures) nearly equal to the downdraft-drying zone (DDZ) air temperatures in section 52 of the same furnace.

A maximum temperature of about 2400° F. is measured in the firing or ignition zone 102 of the furnace. The area of particular interest is the firewall 100 separating ignition zone 102 from the heat recovery zone or recuperation zone 104. This area is typically constructed of heat resistant brick, about eight feet wide and about six inches above the top of the pellet bed 14. The standard thermocouple tests indicate a temperature of 2400° F. through the entire eight-foot width of the firewall 100. The hot air is sucked down through the pellet bed 14 in the ignition zone 102. Part of the high temperature can be attributed to the fact that the furnace pressure is slightly positive (0.05 to 0.10 inches water gauge) This pressure will drive some combustion gasses towards the heat recouperation zone of the furnace. Because the hot combustion gasses are sucked down through the bed of pellets 14, the supply of positive air pressure is neutralized. Therefore, it is reasonable to postulate the theory that reflected radiant heat is most likely responsible for maintaining the 2400° F. temperature in the zone below the firebrick in the furnace. The oxygen in the gasses below the firebrick zone 100 is low. The estimated oxygen content would probably be 10% to 15% as a high value.

When the thermocouple passes beyond the firebrick zone 100 of the furnace, the temperature lowers significantly, immediately reaching a temperature below 1500° F. By the time the thermocouple has traveled eight feet the temperature is less than 1000° F. This is significant because the hot air traveling downward into the pellet bed contains 21% oxygen. Previous sources have determined that little effective oxidation occurs when the pellet temperature is less than 1500° F. Pellets on the top of the pellet bed 14 usually are of the lowest quality of the entire depth of the pellet bed. The lower quality is because the pellets had excessive water content when the pellet firing began. The result of this higher-than-desired water content is magnetite cores and also cracks in the pellet structure possibly caused by the pressure increase due to escaping steam. The pellets with the small cracks usually have magnetite cores. It would be desirable for the top pellets to be oxidized by being exposed to temperatures exceeding 1600° F. with 21% oxygen. However, the higher temperatures are not achievable in the present operating conditions. Obviously, oxidation occurs at lower temperatures, however the oxidation rate would not be adequate to improve the quality of pellets on the top of the pellet bed.

There are two major shortcomings in prior art furnaces. First, I find there is very little oxidation of the pellets under the firebrick zone 100, even though the temperature is about 2400° F. Second, I have found that the top of the pellet bed loses heat by radiation to the walls of the recirculation hood. Practically no heat is radiated back to the top of the pellet bed. The area in the firebrick zone 100 at the end of the furnace has adequate temperature to oxidize some of the magnetite cores in the center of the pellets, but the reaction proceeds very slowly because the oxygen concentration is too low.

The furnace zone after the firing zone 102 is called the recuperation zone 104. The recuperation zone 104 is where the majority of pellets are fired. If it is correct to say that the top two inches of the pellet bed 14 is fired in the firing zone 102 of the furnace, then the bottom 14 inches of the pellet bed is fired in the recuperation zone 104 of the furnace. The pellets fired in the recuperation zone 104 are fired in a concentration of nearly 21% oxygen. In accordance with the present invention, furnace modifications are located above the pellet bed in the recuperation zone. The present invention is intended to improve, among other things, the quality of the top two inches of the pellet bed. A slight but significant improvement will benefit pellets fired in the recuperation zone.

Firing in the production furnaces proceeds as described. The partially dried pellets leave the updraft-drying zone (UDZ) and enter the downdraft-drying zone (DDZ) 52 before being conveyed to the firing zone 102. In the firing zone 102, i.e. downdraft firing zone (DFZ), combustion of the chosen fuel takes place. The temperature in the firing zone 102 is raised initially to 1600° F. to 1800° F. The pellets can then be heated to about 2100° F. in a preheat zone and finally to about 2400° F. in an ignition zone. The heated gasses and water vapor are drawn through the pellet bed 14 by a fan generally called the waste gas fan.

The pellets are then conveyed under the firebrick area 102 separating the firing zone 102 of the furnace from the recuperation zone 104.

Figure 14:
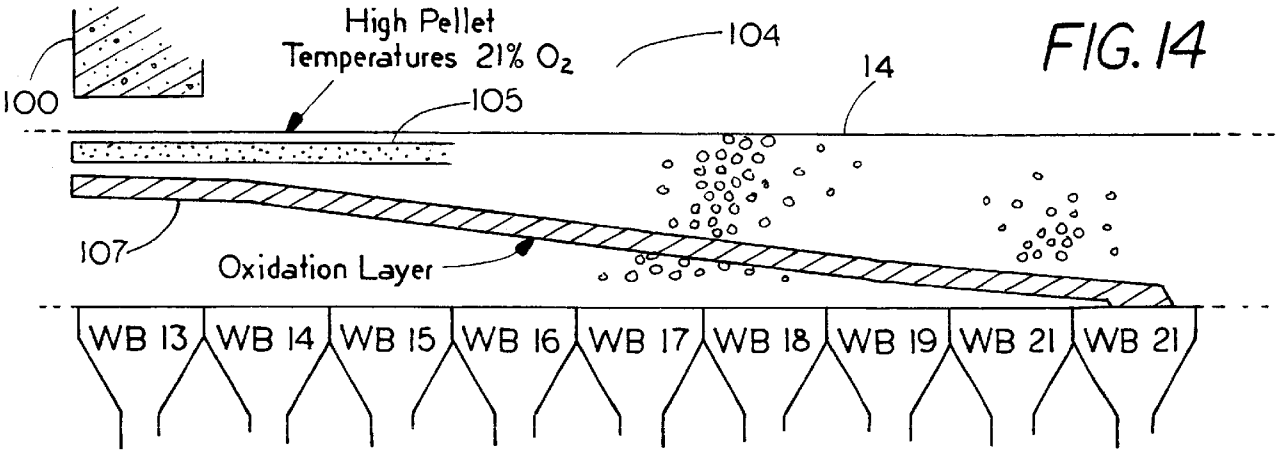
FIG. 14 is a diagrammatic sectional view on a smaller scale of the region of windboxes 13–21.
Figure 15:
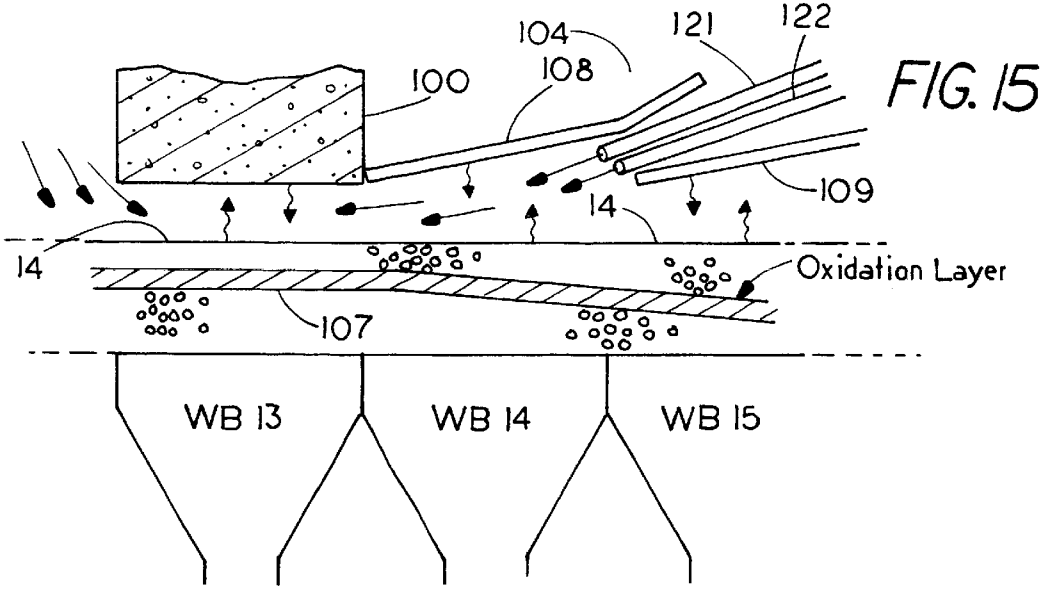
FIG. 15 is a diagrammatic sectional view on a larger scale to show airflow above windboxes 13–15.

Refer now especially to FIGS. 14 and 15. The recuperation zone 104 fires the majority of the pellets. Firing occurs because the fan under the recuperation zone 104 draws relatively hot air down through the pellet bed 14. The hot air is drawn through a section of the pellet bed where oxidation from magnetite to hematite is occurring. This is an exothermic reaction. The oxidation takes place in a high pellet temperature zone 105 (FIG. 14) about two inches below the top of the pellet bed 14 while the pellets are below the firebrick area 100 of the furnace. Because of limited oxygen for the reaction, the same area is oxidized over the second windbox (#14) in the recuperation section of the furnace. The heated air above windbox #14 contains about 21% oxygen, so that oxidation takes place efficiently. The area of the pellet bed 14 that is being oxidized is somewhat easier to visualize if one considers the combustion zone to like a blanket. The zone is across the entire width of the conveyor in a traveling grate machine, and slightly below the two-inch depth in this example. The pellet oxidation layer is constantly drawn down in the pellet bed by the suction of a recuperation fan 106 that serves that section of the furnace.

By reference to FIGS. 14 and 15 it will be seen that the oxidation zone or layer designated 107 has a thickness of two to three inches at the top of a 16-inch thick bed of pellets. The pellet bed thickness as well as the pneumatic resistance and the negative suction of the recuperation fan control the speed that the oxidation layer progresses in a downward direction. It is necessary that the pellet oxidation be completed in the recuperation zone of the furnace.

Figure 12:
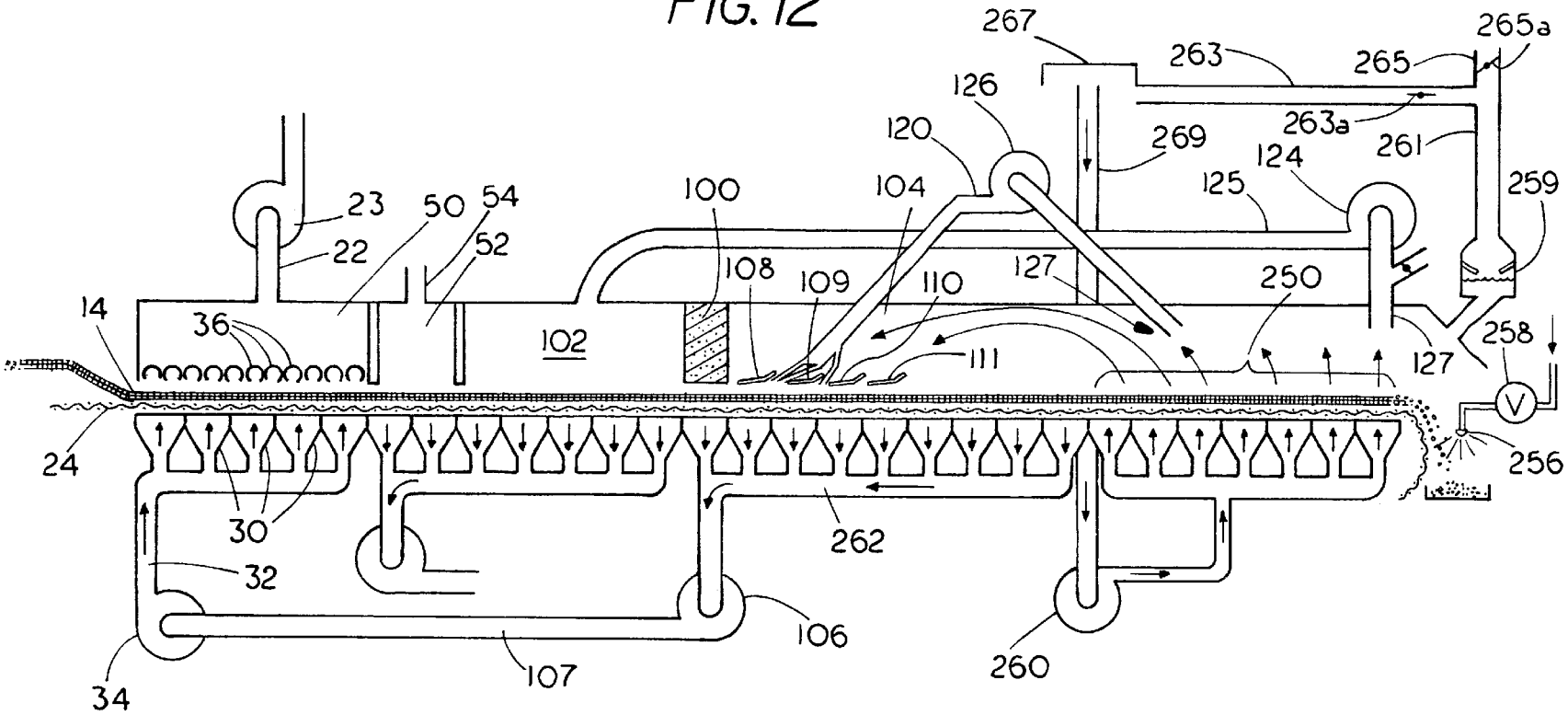
FIG. 12 is a diagrammatic vertical longitudinal sectional view illustrating other aspects of the present invention.

The next zone of the pelletizing machine is the updraft cooling zone (UCZ) 250 (FIG. 12). Here relatively cool air is blown up through the pellet bed 14. The purpose of this zone is to cool the pellets, but a more important purpose is to recover heated air for combustion purposes in the firing zone of the furnace. In the recuperation zone of the furnace, most of the recovered hot air is sucked down through the pellet bed to provide hot air containing about 21% oxygen for improved pellet oxidation.

In accordance with the invention, radiant heat reflectors 108–111 (FIGS. 12, 13 and 17) are installed with reflector 108 nearly touching the firebrick wall 100. The remaining radiant heat reflectors 109–111 can be mounted in-line with reflector 108, with an opening between each adjacent reflector as shown. The radiant heat reflectors 108–111 should be nine feet in length and placed about four inches above the pallet side plates of conveyor 24. The travelling grate conveyor 24 is a multitude of pallets eight feet wide by two feet in length. The pallets have wheels that roll on standard railroad tracks (not shown) in and outside the furnace. The radiant heat reflectors 108–111 can comprise a layer of a suitable reflective ceramic substance, e.g., firebricks, and an initially plastic but fusible type of ceramic insulation such as Gunnite®. However, other materials with even better reflective properties can be installed as will be apparent to those skilled in the art. The radiant heat reflectors 108–111 each have a sturdy steel supporting frame 112 (FIG. 13) connected to the wall or floor of the furnace. The purpose of the radiant heat reflectors, as the name implies, is to reflect radiant heat back onto the pellets on the top of the pellet bed 14.

Therefore, in a typical oven each radiant heat reflector is eight feet wide and nine feet in length. One end portion of the radiant heat reflector about three feet long is angled upwardly about 30 degrees. The second radiant heat reflector 109 is placed eight feet from the end of the first radiant heat reflector 108 so that the end of the second radiant heat reflector is under the angled end portion of the first reflector. The second radiant heat reflector is shaped like the first one with the final three feet angled upwardly 30 degrees. There may be an advantage of installing four or even more such reflectors. More can be installed depending on the benefit derived from the first four in a particular oven.

The purpose of the radiant heat reflectors 108–111 is to raise the temperature of the top pellets of the pellet bed 14. This is accomplished by reflecting back some of the heat lost by radiation. An increase in temperature should accelerate the oxidation of pellets requiring increased oxidation. The oxidation of pellets lower in the pellet bed will be enhanced slightly due to the increased temperature that results from the radiant heat reflectors.

It must be understood that the radiant heat reflectors will raise the temperature of the pellets as compared to the pellet temperature without the use of the radiant heat reflectors. The radiant heat reflectors reduce the radiation mechanism by which pellets lose much of their heat. The radiant heat reflectors action does very little to heat the air. The air is heated by flowing around and contacting the hot pellets.

The first radiant heat reflector 108 should produce the greatest effect. The temperature of the top of the pellet bed 14 should average about 2200° F. With an oxygen content of 21%, the first radiant heat reflector 108 is expected to oxidize some of the pellets with magnetite centers and also some magnetite centers of the pellets with cracks caused by escaping steam. The second radiant heat reflector 109 improves the oxidation of magnetite cores, especially if the added time is beneficial. The temperature under reflector 109 may be as high as 1500° F. The temperature is lower for each additional radiant heat reflector 110, 111. These results occur without considering additional features of the invention described hereinbelow.

Another advantage of the radiant heat reflectors is to improve (raise) the oxygen content of the gasses beneath the firebrick area separating the ignition furnace from the recuperation zone 104. A fan is used to collect hot (as hot as practical) air and direct it towards each radiant heat reflector 108–111 (FIG. 13).

Figure 13:
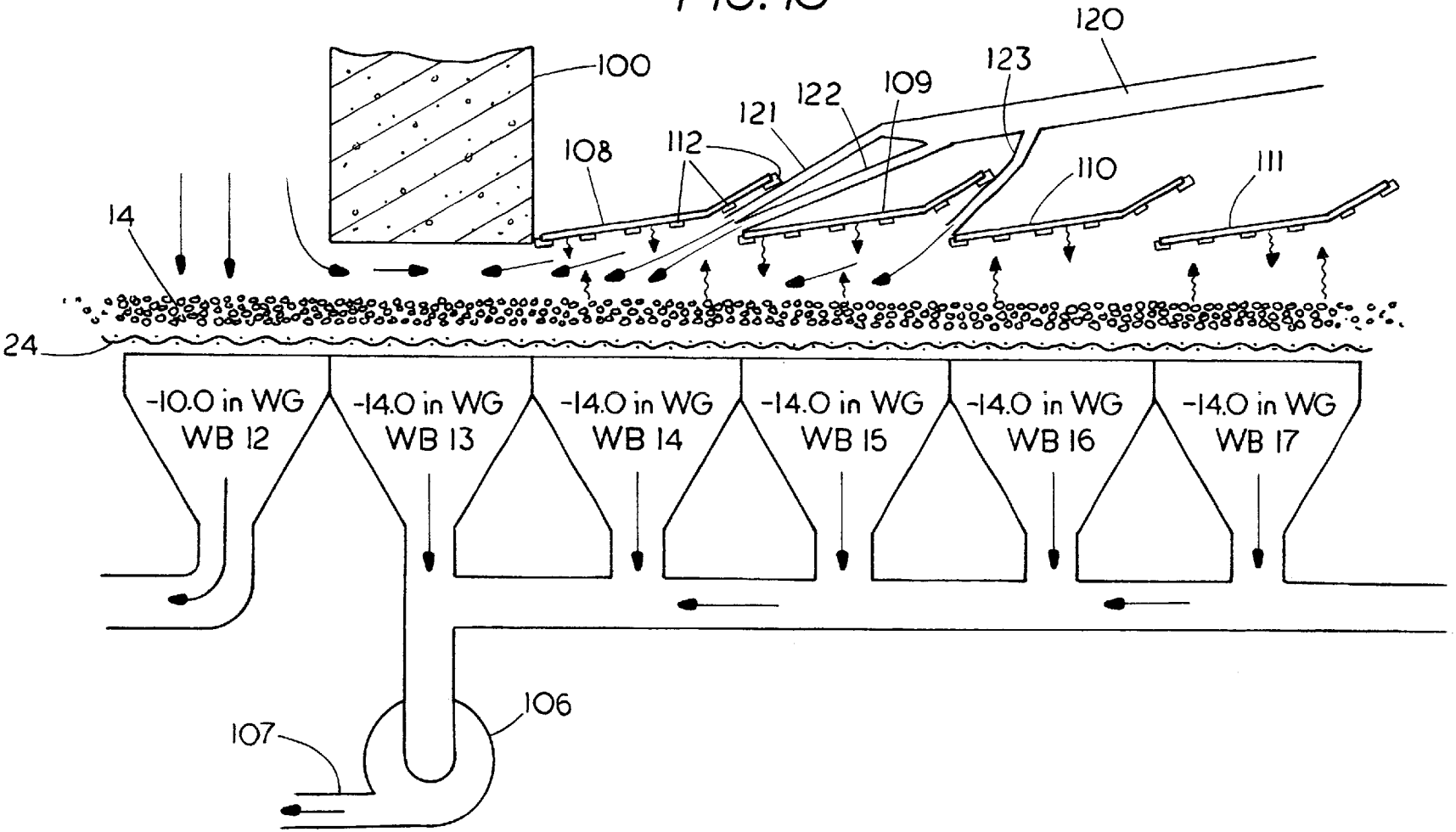
FIG. 13 is an enlarged diagrammatic sectional view in the area of windboxes 12–17.
Figure 17:
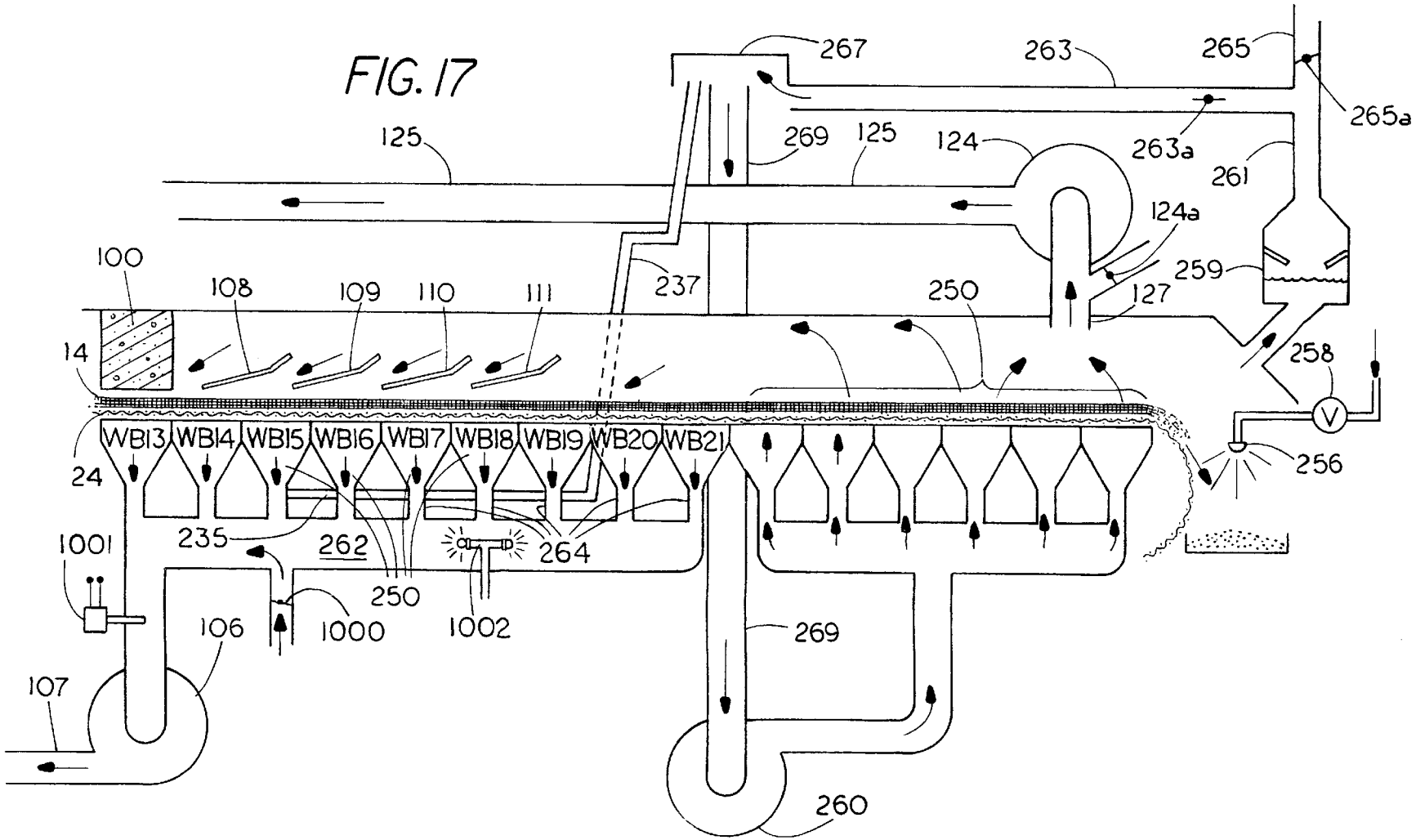
FIG. 17 is a diagrammatic sectional view on a reduced scale relative to FIG. 16 to illustrate the furnace from windbox 13 to its outlet end with ductwork 120–122 removed for clarity.

Refer now to FIGS. 13 and 15. Hot air is supplied through ducts 120–123 at sufficient velocity by a special fan 126 or, if desired, an air ejector of known construction for this purpose that draws air from the updraft cooling zone (UCZ) 250 near its outlet end at 127 to provide momentum to the air under the reflectors. The fan 126 inlet is located where the maximum air temperature is within the fan's operating limit. Additional air moving devices such as air ejectors of suitable known construction can, however, be used to direct air at temperatures above the safe operating temperature for a fan. The air is given the momentum required to go under the firebrick area. The system provides sufficient volume and momentum to the air to cause the air to travel under the firebrick zone 100, preferably about five or six feet under the firebrick area. There is sufficient air volume to provide oxygenated air (21% oxygen) to make up to 50% of the air being sucked into windbox #13. The added oxygen and the high temperature is calculated to oxidize the magnetite cores and cracked pellets that have such a negative impact on pellet quality and reduced low temperature breakdown (LTB). The radiant heat reflectors 108–111 and the additional fan 126 (FIGS. 12 and 17) provide higher quality product, as well as extra furnace capacity as an additional option. FIGS. 12 and 17 show how furnace air at the outlet end of the furnace passes through a dust collector 259 of the wet type through ducts 261 and 263 (and optionally to the atmosphere through outlet 265) to a collection hood 267 in the nature of an inverted trough at or near the ceiling. Air from the hood 267 is forced by updraft cooling fan 260 into the updraft cooling zone windboxes 250.

Above the UCZ 250, hot air is withdrawn at 127 by furnace fan 124 and forced via duct 125 into the firing zone 102 (FIG. 12). A tempering air damper 124*a* (FIG. 17) near the inlet of fan 124 is used to admit room air if furnace air is above the operating temperature of fan 124. Control dampers 263*a* and 265*a* are provided in ducts 263 and 265, respectively. Recuperation fan 106 forces air via duct 107 to fan 34 supplying air to the UDZ 50.

Figure 16:
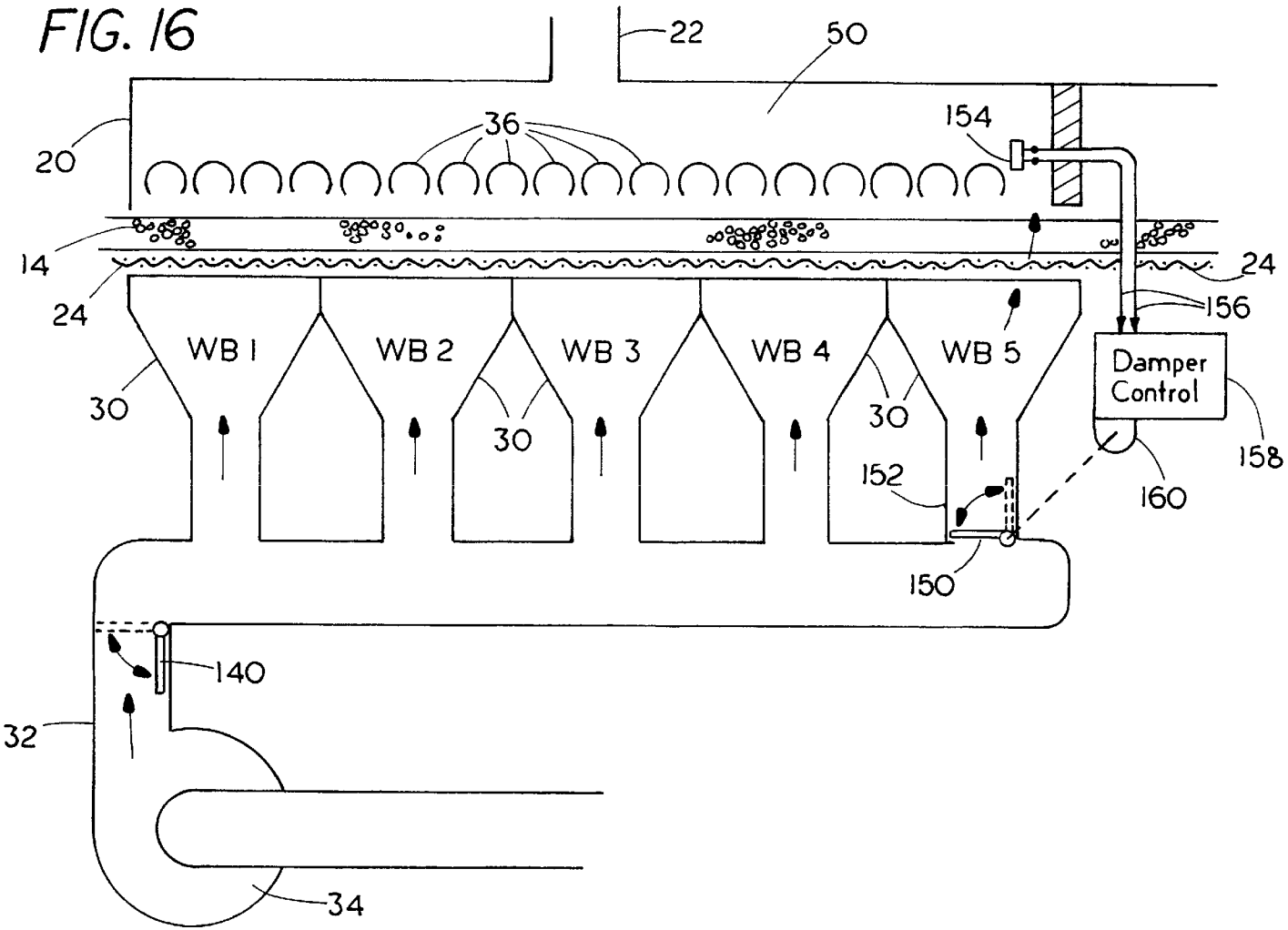
FIG. 16 is a diagrammatic sectional view on a scale smaller than FIG. 15 of windboxes 1–5 to show air control to windbox 5.

Refer now to FIG. 16 in connection with another feature of the present invention wherein the same numerals refer to corresponding parts already described.

The taconite pellets are placed upon an eight-foot-wide grate 24 traveling grate pelletizing machine at a pellet depth of about 15 inches to form a bed 14. As already noted, the first zone of the furnace is the updraft-drying zone (UDZ). The purpose of the UDZ is to supply hot air at 850° F. to begin drying the taconite pellets. The grate 24 travels about eight feet per minute. Each of the five windboxes is eight feet by eight feet. Therefore, to travel above all five windboxes (40 feet), any individual pallet (also any individual pellet) will be in the UDZ for five minutes.

The hot drying air is supplied by a large updraft drying fan (UDF) 34 (FIG. 16) that forces a current of air up through the bed of pellets 14. The UDF characteristics and the volume of air supplied to the fan determine the volume of air and the static pressure that provides the energy to force air up through the bed of pellets 14. The volume of air in cubic feet per minute and the static pressure measured in inches of water column height provide information to the machine operators. The static pressure measured is the result of fan air pressure and volume plus the pneumatic resistance of the bed of pellets. Pressures are measured in inches of water gauge. A common value is, say, 30 inches water gauge. The pressure is distributed evenly throughout the UDZ of the furnace.

It must be understood that the process of drying pellets consists of hot air evaporating water from pellets on the bottom of the pellet bed 14. Evaporating water cools the stream of hot air by an amount consistent with the heat of vaporization of water. The slightly cooler air eventually becomes saturated with water (100% relative humidity). The temperature of the saturated air is equivalent to the dew point temperature. When the saturated air comes in contact with pellets cooler than the dew point temperature, water is condensed out of the air stream and forms on the cooler pellets. When water condenses on the cooler pellets, the pellets are warmed by the amount of heat consistent with the heat of vaporization of water. Subsequent evaporating and condensing move up through the pellet bed to heat the pellets and remove water from the surface and interior of the pellets in the UDZ of a typical pelletizing machine.

The drying action progresses further in each windbox 1 through 5. As the drying progresses, so does the volume of air that is forced up through the pellet bed 14. Although the static pressure under the pellet bed 14 remains constant throughout the entire UDZ, the volume of air passing through the bed increases relative to the lower pneumatic resistance of the pellet bed because of the reduced water content of the pellets, primarily due to reduced surface water content. Thus, more air goes through the pellet bed 14 as the pellets travel through the UDZ of the furnace. More air flows through windbox 5 than any other windbox relative to the area exposed to the updraft drying zone air.

Another way to describe the pneumatic resistance variation is to consider that moist pellets have a tendency to adhere to the other moist pellets that make up the pellet bed. Though the water is removed slowly from the pellet bed, the water removal increases with time in the UDZ of the furnace. This would be one more way to explain that more air passes through the area of the UDZ that has the least water on the surface of the pellet. The least surface water obviously exists at windbox 5. An additional way to explain the increase in airflow is to consider the weight of pellets relative to their water content. The weight of material is less as the water is evaporated over time. Again, windbox 5 can be seen to have the driest and lowest weight pellets.

These concepts are introduced to help explain what happens when additional conditions exist or are created that reduces the pneumatic resistance of the pellet bed. Inadvertent conditions sometimes occur that cause a decrease in the pneumatic resistance or otherwise permit an increase in the airflow through a small segment of the pellet bed. This situation is called a blowhole.

Lower pneumatic resistance can be caused by a decrease in pellet bed thickness that may occur when the furnace pellet supply is momentarily reduced making a low spot on the bed. The more common cause is a broken grate bar. Grate bars make up the bottom of the pallets that are the essential part of the traveling grate conveyor that transport the pellets through the various zones of a pelletizing machine. It is easier to explain what occurs in a blowhole caused by a broken grate bar. Consider that a grate bar is ¼ inches wide and 24 inches long. A broken bar may have about three inches missing. This will create a small hole at the bottom of a pallet. When green pellets or hearth layer pellets are placed upon the traveling grate conveyor, a portion of the pellets will fall through the hole. This will slightly reduce the pneumatic resistance in this small section of the traveling grate conveyor.

The traveling grate conveyor continuously moves the pellets to the first zone of the furnace called the updraft-drying zone (UDZ). The UDZ forces hot air up through the pellet bed with a pressure of about 30 inches water gauge. Due to the broken grate bar and the lower pneumatic resistance, hot air will preferentially flow through the small area of lower resistance. The airflow will increase until after four minutes (at the end of windbox 4) there may be a small channel through the pellet bed 14. This will permit hot air to preferentially flow through this area of reduced pneumatic resistance. Additional pellets along the side of the hole, plus many on top of the hole area, will be carried by the air with its higher velocity above the pellet bed. The pellets will break and form a dust cloud that can be detected. When a dust cloud or blowhole is detected, a large furnace damper shuts off the air in the updraft-drying zone of the furnace (FIG. 16).

The damper 140 closes in about 30 seconds. When the damper 140 is closed, very little hot air goes through the pellet bed 14. After about 60 seconds, the operator or other control mechanisms start to open the damper 140. Opening the damper 140 takes about 60 seconds if there are no other blow hole problems. Air is restricted in the UDZ for a total of about 2½ minutes. During that time, the grates travel about 20 feet. When the air in the UDZ is restricted, the flow of air through the recuperation zone is also restricted, adversely affecting another 20 feet of pellet firing. In the UDZ an additional 20 feet of the pellet bed 14 has about 50% of the normal drying air. The reduced air volume adversely affects pellet quality. The same condition occurs in the recuperation zone 104, duct 262 (FIG. 12) where an additional 20 feet is adversely affected because the pellets there require 100% of the available airflow for complete oxidation. During the same 2½ minutes, the blowhole goes into the firing zone of the furnace. The reduced pneumatic resistance results in more hot combustion air going through the area where the blow hole occurred, thereby adversely affecting the pellets in the entire 40 feet of the firing zone of the furnace.

These problems continue for a few more minutes, but with reduced severity. It must be understood that the problems that I am presenting are not complete disasters, but rather conditions that an operator would want to avoid today because of the current requirement for high quality pellets. A small blowhole would create lower quality production for about one-half hour. During the same time period the pellets produced have characteristics that contribute to the dust problem. The pallet with a broken grate bar would have to be identified and removed at considerable time expenditure and inconvenience. Quite often, two or three blowholes occur before a pallet is removed.

During the time of a blowhole, another adverse change takes place. Besides physically blowing a hole through the pellet bed, a large volume of pellet fragments settle back onto the surface of the pellet bed. These fragments restrict airflow by slightly sealing the pellet bed. When fired, the fragments in essence become broken pellet chips.

To solve the blowhole problem, the present invention provides a damper 150 to shut off air to windbox 5 only when a blowhole is detected. The damper 150 is installed on the main header 152 to minimize the movement of the crossover duct when the damper is closed. The closing of the damper 150 is controlled by a photocell 154 that senses pellet dust near and above the end of windbox 5 (FIG. 16). The photocell 154 is wired by conductors 156 to a controller 158 and damper motor 160 which is in turn connected to the damper 150 for shutting the damper 150 when pellet dust activates photocell 154. An important advantage is the immediate action that is provided. A single windbox cut off from the air supply still leaves the other four windboxes to provide their full volume of drying air. The damper 150 is closed in about five seconds and opened in about 10 seconds. However, after closing, the controller 158 automatically opens damper 150 again after about another 20 seconds. Considering the short time (35 seconds) that air would be restricted, a minimum amount of pellets would be exposed to reduced drying air. Also with the quick response, the blowhole would not become enlarged and therefore could be kept small.

The benefit resulting from the reduced area of lower quality pellets and the reduced time of exposure to restricted airflow is shown in Table 1 below.

TABLE 1

| Length of Restricted Air Flow Area | | |
|---|---|---|
| | Prior Art | Invention |
| Updraft Drying Zone | 40 feet | 8 feet |
| Recuperation Zone | 40 feet | 8 feet |
| Firing Zone | 40 feet | 8 feet |
| Total | 120 feet | 24 feet |

Other aspects of the invention will be better understood by reference especially to FIGS. 12 and 17 in which typical operating conditions of the invention are presented by way of example.

The updraft cooling zone (UCZ) 250 of a standard traveling grate furnace is designed to transfer heat from a mass of fired pellets to be used in other sections of the furnace. The heat is transferred to air that is forced up through a bed of pellets (hematite pellets with some magnetite cores). The mass of pellets estimated temperature exceeds 1200° F. The pellets have a specific heat of 0.16. Using the engineering measuring and calculating devices are somewhat misleading. The heat transfer mechanism is confounded by the fact that air blowing by hot pellets cool the outer circumference of the pellet, but the center mass is not cooled as efficiently because of the poor heat transfer properties of the pellet structure. It must be realized that the pellets are in the updraft-cooling zone for about six minutes. When the pellets leave the last UCZ windbox, the surface temperature increases significantly because the center of the pellets are significantly hotter than the pellet surface.

Dry air has a specific heat of about 0.10 and water vapor has a specific heat of 0.13. An important objective of the invention is to increase the amount of water vapor in the UCZ air. It must be understood that water vapor is present during the summer months so as to provide an average dewpoint of about 40° F. value. This dewpoint corresponds to about 0.005 pounds of water per pound of dry air. The average dewpoint during the winter months, however, is about 0.001 pound of water per pound of dry air. Humidification of the UCZ air that results from the present process will increase the dewpoint to about 65° F., with a corresponding water content of 0.012 pounds of water per pound of dry air. The total airflow of the UCZ is about 160,000 scfm with a weight of 12,000 pounds per minute dry air and with humidification of about 140 pounds of water per minute.

Unconditioned UCZ air at 250 will have a normal water content of less than 0.5% in the summer and about 0.1% in the winter months. According to the present invention, the UCZ air is conditioned by the addition of moisture. The conditioned UCZ air will have a water vapor content of about 1.2% during both seasons, or 2.4 times the water vapor content during the summer and 12 times the winter value.

The additional water vapor will provide the benefit of enhanced cooling of the pellets while the pellets are passing through the UCZ. It is estimated that the pellets may be 30° F. to 50° F. cooler. The pellets will have a temperature of about 450° F. rather than the 500° F. for an equivalent prior art system without conditioning. These temperatures are the average temperature for the pellets leaving the UCZ of the furnace and appear to be much hotter than the desired temperature, but are what commercial systems are designed to produce. Additional cooling would cause the furnace fan to distribute combustion and roof air at less than the optimal temperature, which happens to be as hot as the fan can safely operate. The UCZ air has previously been modified to blow colder outside air up through the pellet bed. The result was cooler air distributed by the furnace fan. The change was immediately set back to the original configuration.

The humidification of the UCZ air is capable of cooling the pellets without negatively impacting the furnace fan's objective of delivering air as hot as the fan will safely deliver.

Most of the air heated by being forced up through the hot pellets in the UCZ is transferred to the area above the recuperation zone and again moved through the pellet bed. The increased specific heat of the air does have some marginal benefit before reaching the oxidation zone. Once the treated air passes through the oxidation zone, the air has the capacity to transfer some additional heat to the pellets being prepared for oxidation. The humidified air that passes through the recuperation zone is forced through by the suction of the recuperation fan. The recuperation fan supplies the air used by the forced draft fan to start the drying and heating of the pellet bed. The hot (850° F.) humidified air transfers an increased amount of heat consistent with the additional 1% water vapor that is present. The recuperation fan and associated ductwork dilutes the 140 pounds of water per minute to about 90 pounds per minute. Additional leakage reduces the weight of water through the pellet bed to about 70 pounds per minute.

An example of typical moisture and heat transfer conditions will now be presented. Seventy pounds of water vapor will be used in this example. The specific heat of the 1.2% water vapor transfers heat relative to the difference of 0.1 for dry air to 0.13 for water vapor. Compared to summer conditions, the humidified air will have 2.4 times as much water vapor. Sensible heat transfer because of the humidified air will increase slightly. The 1.2% weight of water vapor may increase the heat content transfer by 1.4%. The heat transfer in winter is much greater. This improvement is significant, but there is another benefit of humidified air that is much greater.

The main benefit of humidified air is that the heat of vaporization is significantly higher than either summer or winter operation. Consider the humidified air provided by the present invention as having 0.007 pounds of water per pound of dried air. It takes 13.35 cubic feet of dry air to equal one pound. Using reasonable values, the UDZ air volume is about 133,500 standard cubic feet in volume or about 10,000 pounds of air. If the water vapor content is 0.01 pound of water vapor per pound of dry air, there is 100 pounds of water vapor per minute in the air stream. Because of leakage through associated ductwork, the final weight of water per minute is about 70 pounds per minute. The heat of vaporization is 970 BTUs per pound of water vapor times 70 pounds, or 67,900 BTUs per minute. That is a great deal of extra heat due to hot humidified air. Each BTU by definition is the quantity of heat required to raise one pound of water 1° F.

A furnace operating at 200 tons of pellets per hour is operating at 6,700 pounds per minute pellets. Since the pellets contain 10% water for a total of 670 pounds water per minute, 68,000 BTUs per minute are available with the 70 pounds of water vapor. The invention is easier to understand, if one assumes half of the BTUs for heating the pellets and the other half for raising the temperature of the contained water. Therefore, 44,000 BTUs will raise 6,700 pounds of pellets with a specific heat of 0.16 as follows: 6,700 pounds times 0.16 equals 1072 pounds of pellets with an equivalent specific heat of 1.0. Therefore, 44,000 BTUs divided by 1072 pounds equals a 41° F. increase in a one-minute supply of pellets. This benefit does not result from any other heat input. Previously, pellets were heated without the additional water vapor. It was shown hereinabove that in a short time the center of a pellet would not absorb much heat (perhaps only 50% of a pellet's mass would be heated significantly). With this in mind, the 41 ° F. temperature increase can easily be doubled to 60° F., the temperature increase moving the surface temperature of all the pellets well above the dewpoint.

The remaining 34,000 BTUs are available to heat the water in and on the pellets. The water makes up 10% of the 6,700 pounds per minute pellets or 670 pounds of water with a specific heat of 1.0. Therefore, 44,000 BTUs will heat 670 pounds of water to a temperature increase of 50° F. Again, nearly 50% of the water will be in the center of the pellets. Consequently, it is estimated that the additional water vapor will raise the temperature of the available water to a temperature increase of 100° F. This temperature rise considers only the heat of vaporization of 70 pounds of water vapor. It should be noted that there is fairly good heat transfer without humidifying the UCZ air. This improvement coupled with the enhanced jet drying, radiant heat reflectors and windbox five dampers, produces greater benefits.

The calculations used in this example assume a reasonable amount of humidification of the UCZ air. The value of 0.012 pounds water per pound of dry air is easily obtained for air with a dewpoint of 65° F. A high summertime dewpoint of 90° F. is common in many southern Gulf coast states. To obtain humidification of 65° F., the hot humid air from one dust collector may have to be supplemented by a second source of steam. Since the volume of air used for updraft cooling exceeds 160,000 scfm, 12,000 pounds of dry air times 0.010 pounds water per pound of dry air results in about 120 pounds water vapor. With the dilution factor, the amount of water forced upwardly through the bed of pellets results in about 70 pounds water vapor that was used in the updraft drying zone example.

It is recommended that tests using a small amount of water vapor such as in this example be used initially. More water vapor can e used later depending on how the furnace reacts to the added heating and drying obtained.

The following calculations consider the benefit of 0.012 pounds water per pound of dry air for a period of one minute. The cooling in the updraft cooling zone (UCZ) lowers the pellet temperature by about 40° F. Additional time, such as five or six minutes, would probably lower the temperature so that it is at least 50° F. cooler because of the limited heat transfer characteristics of pellets.

However, the calculations for the heat transfer in the updraft drying zone (UDZ) remain quite reasonable when the additional four minutes of air exposure is added to the dewpoint of 50° F. (at 0.007 pounds water per pound of dry air). The calculated value is reasonable because new green pellets are placed upon the pellet conveyor each minute. The temperature increase for both the outer half of the pellet mass and the outer half of the contained water both indicate a temperature increase of about 80° F. These calculations do not consider the sensible heat transfer from the dry air component of the updraft drying zone (UDZ) air. The dry air component will evaporate water from the surface of the pellet and also transfer heat to the pellets. Without the invention, only the dry air portion heating capability is available.

With 0.007 pounds of water per pound of dry air, it must be understood that the dry air component is 99.3% dry air with 0.7% water vapor. While the majority of the humid air consists of dry air, the water vapor contributes to the heat capacity of the air stream by the values that follow. First, 0.007 pounds water per pound of dry air is 0.7% of the weight due to water, but 4.4% of the heat capacity due to the heat of vaporization of water. By the same token, 0.01 pounds water per pound of dry air is 1.0% weight due to water vapor, but 6.5% of the heat capacity due to the heat of vaporization of water. In addition, 0.02 pounds water per pound of dry air is 2.0% of the weight due to water vapor, but over 12% of the heat capacity due to the heat of vaporization.

The previous calculations were made for the heat capacity due to the heat of vaporization of water vapor. Thus, the water vapor contributes heat due to sensible heat transfer. The sensible heat that the water vapor contributes equals the same percentage of heat (BTUs) as the percent of water vapor. Finally, sensible heat contribution due to water vapor is slightly greater than an equal percentage of dry air.

Thus, the temperature increase of the pellets and the contained water are useful in raising the temperature of the pellets significantly above the dewpoint. This will prevent water from condensing on the surface of the pellets. When coupled with air jets directing hot air down on the surface of the pellet bed, the net result will be pellets that are much drier when they enter the next zone of the furnace. In addition, the surface of the pellets will be smoother and therefore they will create less dust. Greater furnace efficiency will be the most outstanding advantage, but dust abatement is increasingly important for environmental purposes.

It should be recognized that to achieve the temperature benefit from the heat of vaporization, 70 pounds of water would have to condense onto the surface of the pellets when 0.007 pounds water per pound of dry air is used for drying pellets. This is not a problem because there is so much additional heat available.

In accordance with the present invention, hot moist air is obtained from dust collectors with water being used as the dust-collecting medium. Preferably, to obtain moist air in accordance with the invention, water is sprayed on the hot pellets discharged from the end of the furnace by means of one or more sprayers 256 which receive water from control valve 258 (FIG. 17). Hot air and steam from spraying water on the hot pellets provides a source for hot humid air. The equipment described provides economical hot humid air without requiring drastic changes to the physical operating equipment in pelletizing plants now in operation. A dust collector 259 is of the water bath type. Hot air and steam heat the water bath to about 125° F. Air leaving the dust collector 259 has a dewpoint of about 125° F., or 0.095 pounds of water per pound of dry air.

One preferred arrangement according to the present invention provides about 15,000 acfm to be directed by ductwork to the intake of an updraft-cooling fan 260. To provide this volume, one dust collector (and sometimes two dust collectors) can be an economical source of hot humid air. Two collectors may provide some, if not all, of the volume of hot humid air that I estimate will be required. The hot humid air from the dust collectors will be at a temperature and dewpoint higher than calculated for the total in the UCZ air. Therefore, the optional 70 pounds of water vapor may be approached. Tests can, however, be conducted at less than the optimum weight of water vapor to evaluate the benefits. The hot humid air from even one commercial dust collector would probably be an adequate volume of hot humid air to provide the heat of vaporization (heat content) to warm the pellets enough to show advantages such as less dust and reduced magnetite cores and less cracked pellets caused by inadequate pellet drying on the top of the pellet bed.

Another source of hot humid air in accordance with the invention is from steam generated by piping water either through some of the hot ductwork 264 connecting recuperation windboxes at 250 to the main recuperation duct 262. Generally, the transition ductwork is called downcomers shown at 264 in FIG. 17. If this source is used, pipes 235 installed inside the downcomers 264 or attached around the downcomers conduct enough heat to generate steam which is conveyed by duct 237 to a collection hood 267. The volume of steam generated is related to the engineering method utilized. More steam is used for a greater effect. The steam can be discharged near the intake for the updraft-cooling fan. These two sources of humid air will provide adequate water vapor to provide the benefit of slightly increased cooling of the fired pellets and more importantly vastly improve the heating and drying of the green pellets in the updraft drying zone.

Green pellets in the updraft-drying zone will be wet from condensation for much less time using hot humid air than with the air that has no added moisture. The reduced time that a green fluxed pellet is exposed to condensed water vapor in accordance with the invention reduces the roughness and coarseness of the outside of the fired pellets. This is important because the smooth pellets that are produced generate less dust.

An important advantage of the invention is that it transfers some of the waste heat (energy) into hot humid air. The hot humid air can be heated to a much higher temperature and economically transferred to the part of the pellet bed that will benefit most from the additional heat. It is proposed that the pellets on the top six inches of the pellet bed will be warmed (with most of the contained water) at least 65° F. warmer by the additional heat content of the hot, humid air. While various sources of hot humid air have been described, any available source such as a steam generator can be used.

Using the water vapor from the dust collectors can be accomplished by discharging some of the steam and hot humid air that is generated inside the plant to the UCZ rather than discharging the air and water vapor outside the plant. Any air discharged outside the plant, particularly in the winter, must be replaced. The replacement air is cold and very dry. The replacement air enters the building by coming through any leaks that may exist. The process is called infiltration. The inside of most processing plants has an atmospheric pressure somewhat less than the atmospheric pressure outside the building. When one considers a general pelletizing plant discharging hundreds of thousands of cubic feet per minute air and other gasses, it will be realized that the same volume of replacement air must infiltrate back inside the enclosed plant. The plants are always enclosed during the cold winter months. The present invention reduces the volume of air discharged on the order of about 20,000 cubic feet per minute, a very significant reduction.

Still further aspects of the invention will now be described in connection with FIGS. 17–25.

Figure 18:
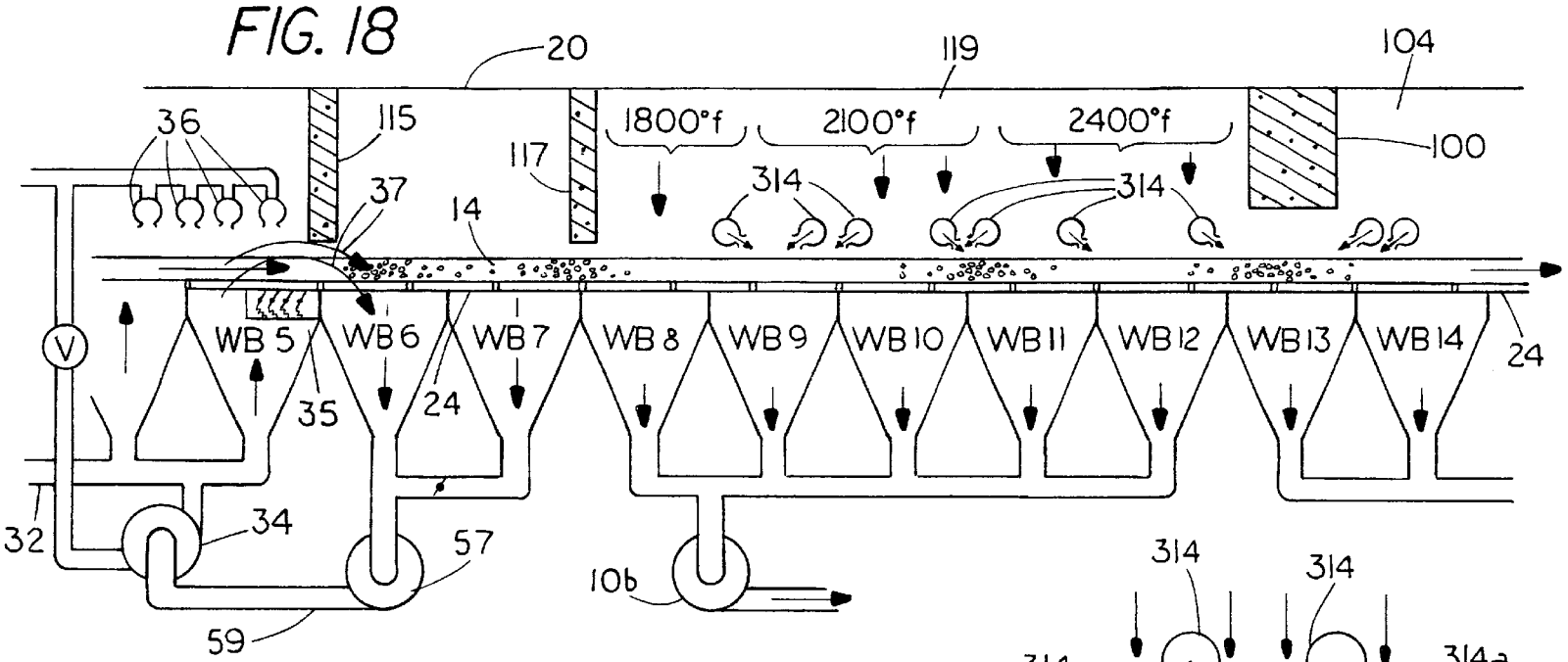
FIG. 18 is a diagrammatic vertical longitudinal sectional view of an ore-treating oven showing another form of hot air jet distribution pipe.
Figure 19:
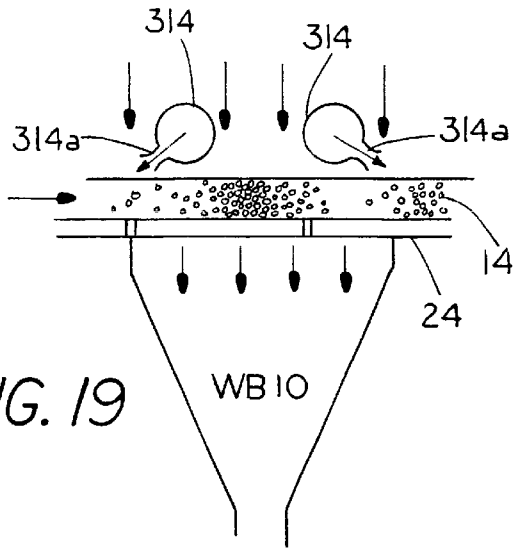
FIG. 19 shows an individual windbox area in greater detail on a larger scale.

Refer first to FIGS. 18 and 19 wherein the same numerals refer to corresponding parts already described.

FIG. 18 depicts a portion of the pellet heat treatment furnace 20 between windboxes 5 and windbox 14. A pair of vertical transversely extending firebrick walls 115 and 117 are provided at the downstream ends of windboxes 6 and 8. In the furnace firing zone 119 between firebrick wall 117 and firebrick wall 100 there are provided a plurality of laterally extending distribution pipes 314 similar to those already described with the air outlet jet nozzles or slots 314*a* (FIG. 19) which are directed downwardly at an angle, typically, at about 45 degrees to the horizontal. It will be noticed that each adjacent pair of nozzles 314*a* are in this example directed toward one another. As already described the jet nozzles 314*a* extend laterally across the entire bed and each can be thought of as a slot nozzle.

Figure 20:
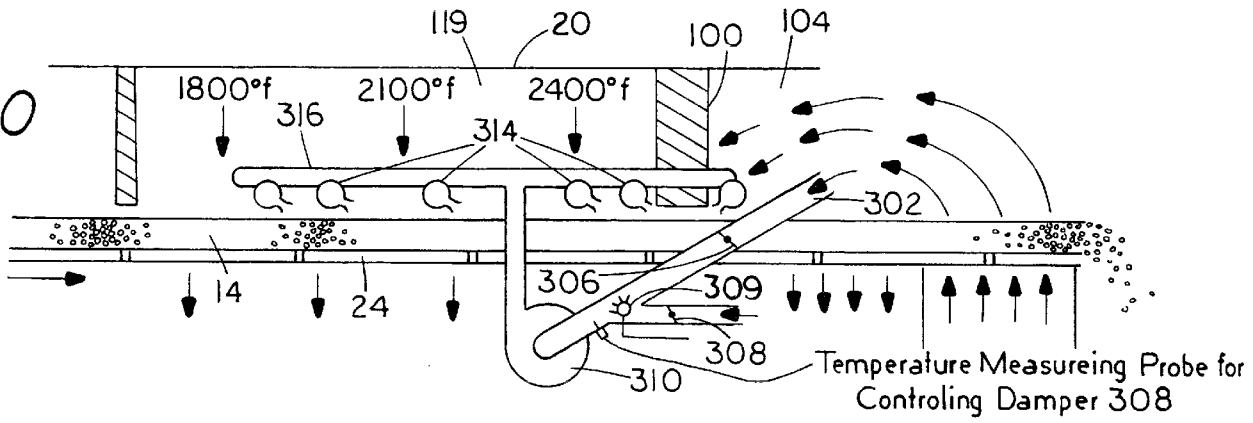
FIG. 20 is similar to FIG. 18 but shows more details of the hot air jet distribution pipes and the high temperature fan.

Refer now to FIG. 20. In this case, the distribution pipes 314 are supplied with hot air by a fan or blower 310 which is connected to a inlet duct 302 that opens into the recuperation zone recirculation hood 104 of the furnace. The air volume is controlled by means of a damper 306 and if desired cold intake air from the atmosphere can be introduced through a second duct under the control of the damper 308 to maintain the temperature of hot air below about 1100° F. The hot air from the fan 310 provides hot air through the distribution ducts so that the jet stream passing out of the nozzles has a temperature of about 1,100° F. to impact the pellets that have been heated by the furnace gasses to a temperature of about 2,100° F. Inside the furnace the 1100° F. air mixes with the 2100° F. furnace hot gasses to direct air at about 1600° F., onto the pellets that were heated to 2100° F.

Figure 21:
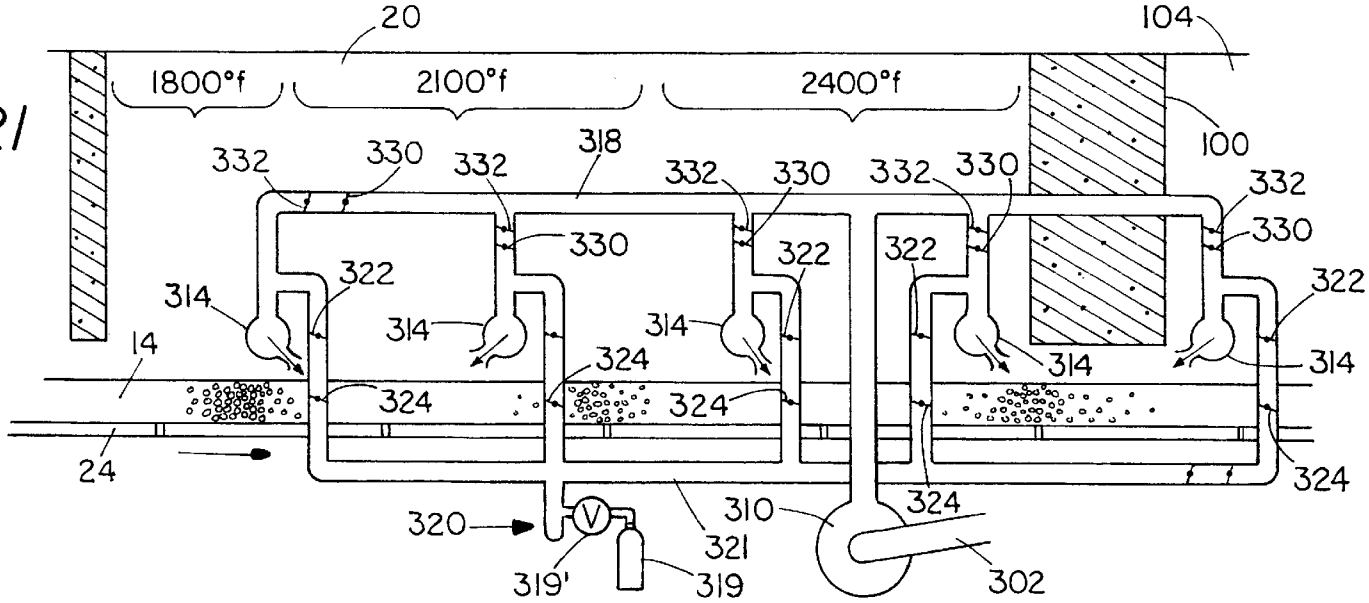
FIG. 21 shows hot air jet distribution pipes in greater detail and the oxygen distribution system.
Figure 22:
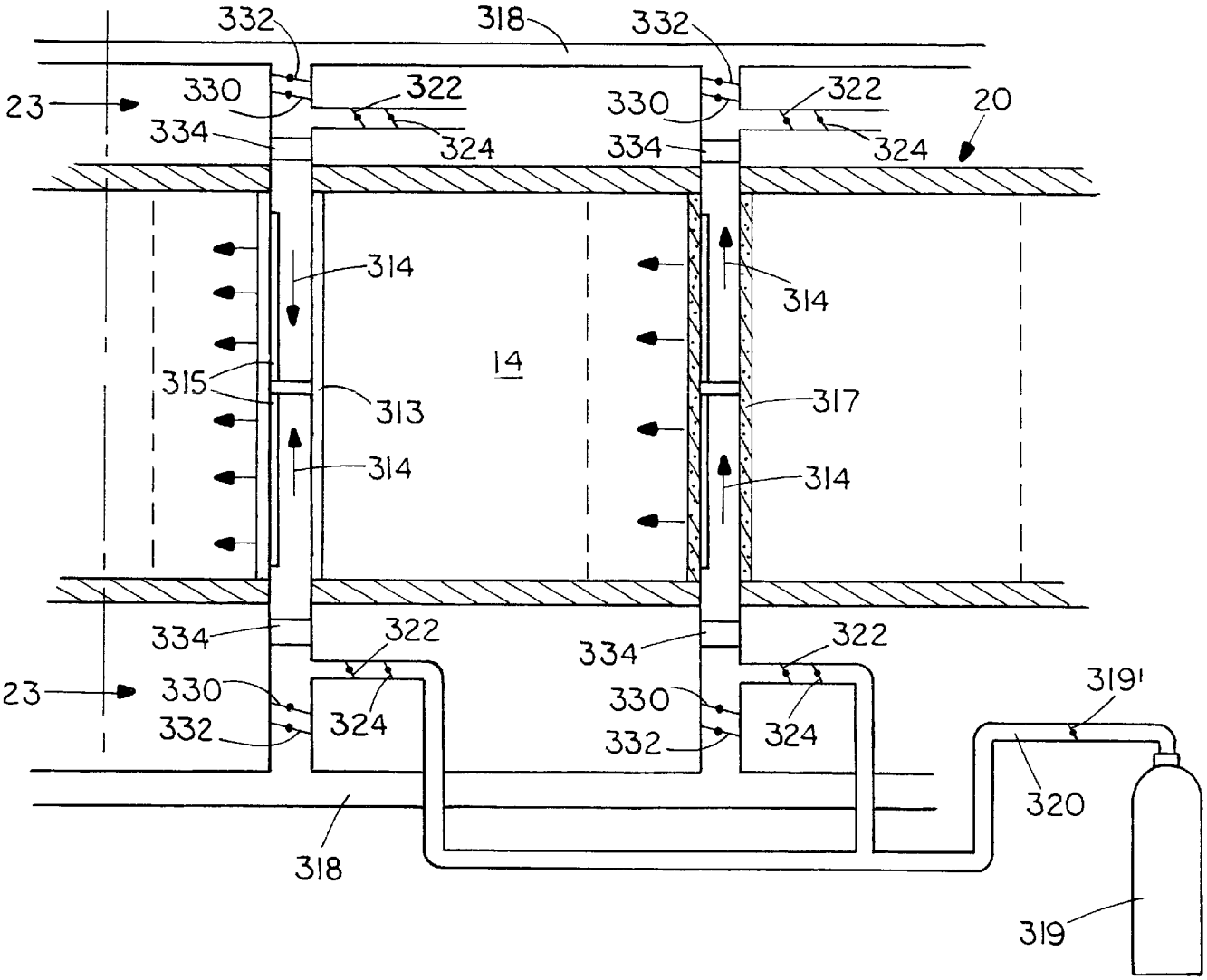
FIG. 22 shows a top plan view of a portion of the furnace including the distribution manifolds and hot air jet distribution pipes.

Refer now to FIGS. 20 and 21 which illustrate the distribution of heated air in more detail. As shown in the figures, hot air form the furnace is introduced through the duct 302 by the fan 310 which supplies the hot air manifold 318 (see also FIGS. 22 and 23). The manifold is where ducts enter the body structure of the furnace. The airflow in the ducts is controlled by dampers 330 and 332. Oxygen is introduced through a manifold 321 (FIGS. 21 and 22). The flow is controlled by dampers 322 and 324. When added oxygen is needed, the oxygen from a storage tank 319 is supplied through a control valve 319' to an inlet duct 320 connected to the manifold 321. By adding pure oxygen from the tank 319, the oxygen content of the air supplied by the jet distribution pipes 314 can be increased from say 21% oxygen to 25% oxygen. Of course higher oxygen concentrations can be provided if desired.

Figure 23:
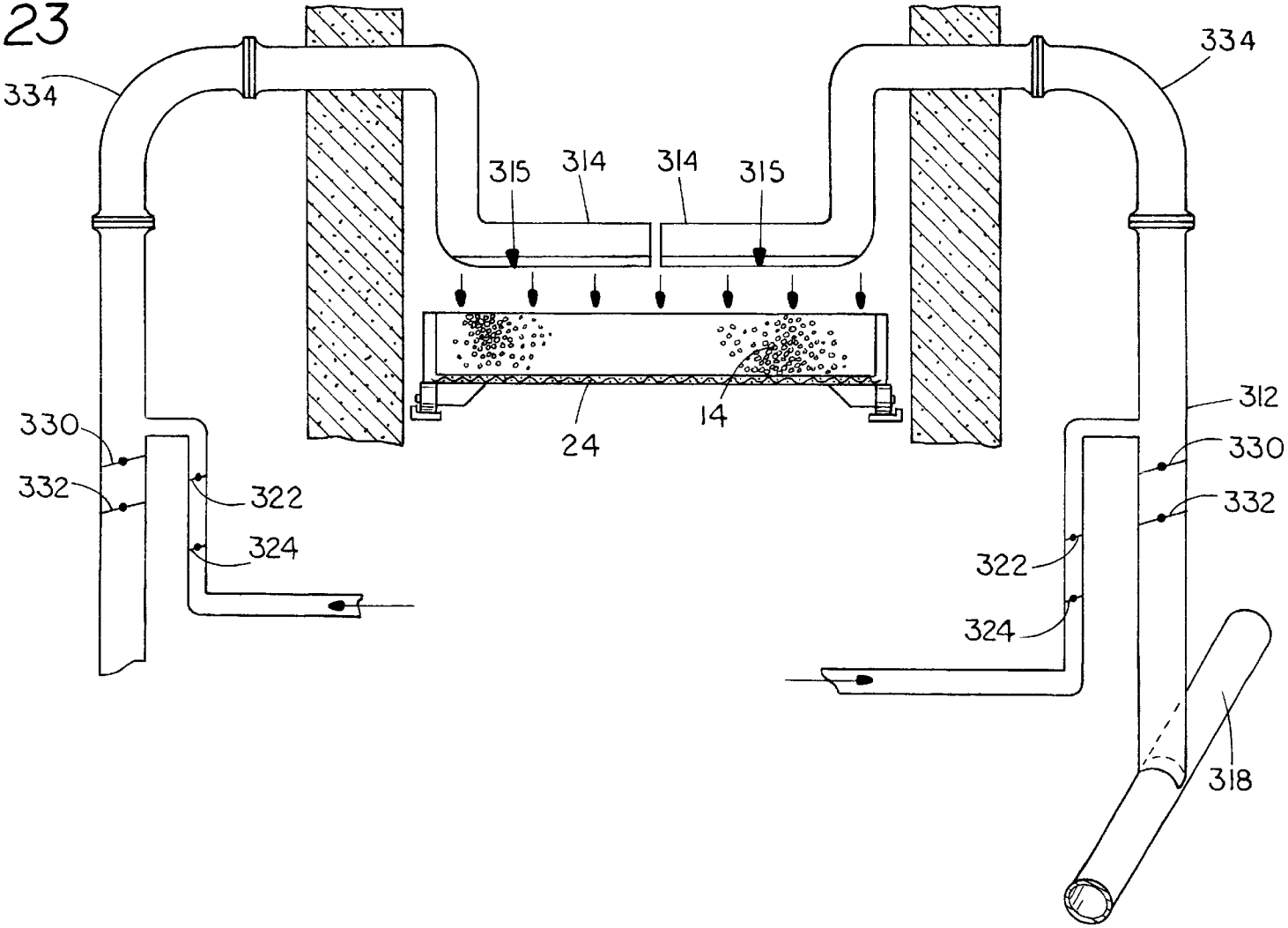
FIG. 23 is a diagrammatic transverse cross-sectional view taken on line 23—23 of FIG. 22.

Refer now to FIGS. 22 and 23 which illustrate how the distribution pipes 314 enter from the sides and terminate at the center of the pellet bed so that the flow of air to the jets is directed centrally from both sides of the furnace. The jet distribution pipes include a left distribution pipe 314 and a right distribution pipe 314 both of which terminate near the center of the pellet bed 14. The distribution pipes 314 in this case are enclosed in a hollow jacket 313 or another pipe 313 which is supplied with cold air, e.g. cool atmospheric air to keep the pipes 314 at a temperature low enough so that they will not become damaged by heat. The cool air supplied to the jacket 313 by any suitable air supply or fan (not shown) is provided in just sufficient amount to cool in pipes 314 without excessive reduction of the temperature of the air supplied through the distribution pipes 314. The distribution pipes 314 at the right of the Figure are similar except they are enclosed within a surrounding layer of insulation 317 of any suitable type known in the furnace art such as a fibrous mineral insulation material for the purpose of keeping the distribution pipes 314 cool enough so that they will not be damaged by heat of the surrounding furnace air. Cooling air and insulation protects the distribution pipes from damage caused by hot furnace air.

Figure 24:
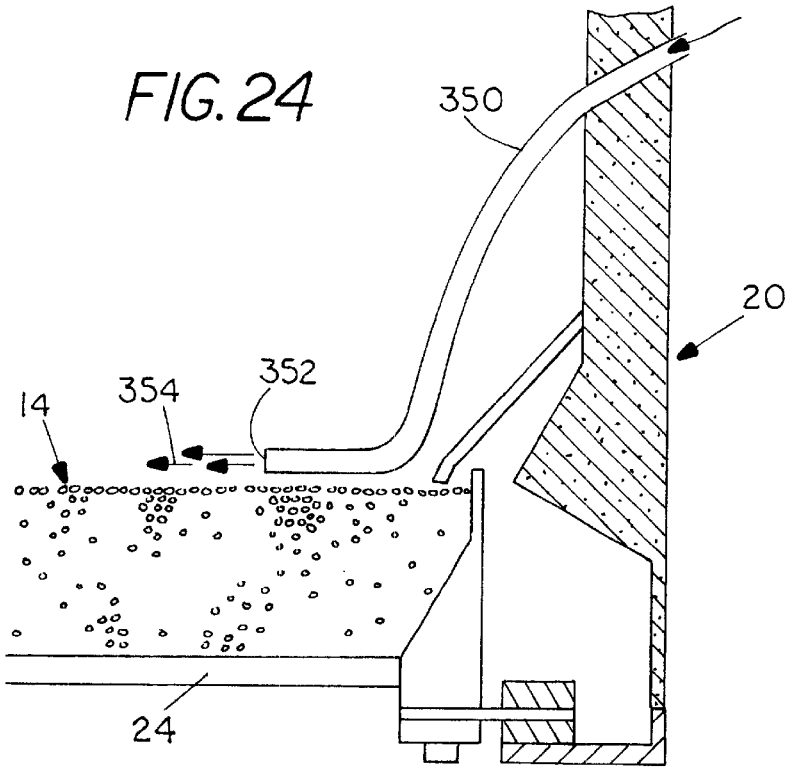
FIG. 24 is a partial transverse cross-sectional view showing an inclined hot air jet supply pipe.
Figure 25:
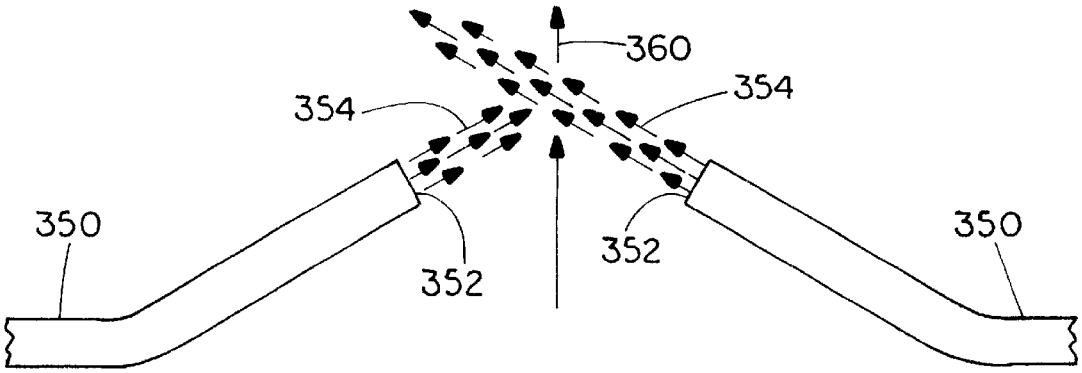
FIG. 25 is a partial plan view of the nozzles of the jet supply pipes of FIG. 23 on a larger scale.

As shown in FIGS. 24 and 25, the pellet bed 14 is provided with hot air through a pipe 350 from any suitable hot air source to a jet nozzle 352. The jet nozzle 352 forces a jet of air 354 centrally at an oblique angle across the upper surface of the bed in the direction of the path 360 taken by the pellets through the apparatus and downwardly toward the bed at a slight inclined angle so as to force a jet of hot air into the upper surface of the pellet bed.

In FIG. 18, the distribution pipes 314 are shown at the preferred locations in the firing section of one type of furnace. While spare distribution pipes can be installed, in most furnaces space does not permit the addition of spare distribution pipes. Distribution pipe 318 (FIGS. 20 and 21) provide hot air jets for the one side of the firing chamber. Those on the other side are similar but for clarity have been omitted. The inclined direction of the hot air jets are indicated in FIGS. 19–21. FIG. 20 shows how hot furnace air enters inlet 302 from the recirculation chamber 104. Dampers 306 or 308 determine the flow from hot and cool air sources respectively.

In FIG. 23, hot air from manifold 318 flows through removable transition piece or elbow 334 (made to expedite the distribution pipe removal) that communicates through an opening into the side of the furnace to the distribution pipe 314 to provide hot air jets at a velocity of at least 3,000 feet per minute. The hot air jets out of duct 314 through a slot nozzle 315 or fan jet sized to provide the desired volume and velocity of hot air to mix with hot furnace gasses at a temperature of about 2,100° F. Hot air passing out through each jet has a temperature of about 1,100° F. The combined jet and furnace air results in a jet of about 1,600° F. air to impact pellets that have been heated by the furnace gasses to a temperature of about 2,100° F. The slot nozzle 315 can be ¼ inch to one inch in width. A typical installation has slots of about ½ inches in width but other widths can be used to meet existing requirements. There is no reason to limit the slot width to a small size width or hence a small volume of hot air directed towards the pellet bed. Indeed there are advantages of selecting larger hot air jet volumes provided that the hot air fan 310 is adequately sized to deliver the volume and static pressure necessary to provide hot air jets at a velocity greater than about 3000 feet per minute. In such a case, a second hot air fan similar to fan 310 is provided so as to supply an adequate volume and static pressure to each side of the furnace. However, if the initial fan selection provides adequate hot air volume to supply hot air to be used on both sides of the furnace only one fan is necessary. After experience has been gained operating this invention, one can determine if one fan is a more reasonable alternative than using one for each side of the furnace. Flow control dampers 330 are used to supply and control the required hot air volume and static pressure whether one or two fans 310 are used.

FIGS. 21 and 22 show an oxygen source 319 with pressure and flow control valve 319' and shut off valve 322 to supply oxygen when desired through the flow control valve 324 for each specific distribution pipe and through manual shut off valve 322. When valve 322 is open, oxygen will mix with hot air to provide additional oxygen through duct 314 and out through the slots 315. Hot air from blower 310 mixes with the oxygen that is carefully measured to have a controlled volume to increase the oxygen content in measured increments.

The oxygen can be added whenever conditions require it. The hot air passing out through the jet pipes 314 optimally contains about 21% oxygen. Twenty-one percent oxygen is significantly more oxygen than the amount available in furnaces without hot air jets of the present invention because so much of the oxygen is consumed in the furnace. A relatively short distribution pipe 314 extending only to the center of the furnace is preferably used for testing purposes and also in the hotter zones of the furnace as shown in FIGS. 22 and 23.

Previously in a typical ore pellet furnace according to the prior art, a hot firing section of the furnace simply employed available hot combustion air heated to higher temperatures by a fuel of choice. All fuels consume oxygen. The amount of oxygen consumed depends upon the temperature of the combustion air and the temperature set point for the particular section of the furnace. The resulting hot gasses are drawn through the pellet bed by a fan commonly called the waste gas fan. The hot air has a volume of about 150,000 actual cubic feet per minute (acfm) and is drawn through the combustion zone of one size furnace of about 420 square feet. The average velocity is about 450 feet per minute down over and through the top of the bed of pellets. The flow is continuous over the entire length of the furnace. The hot air or gasses heat the top pellets to specifically selected temperatures. The gasses are heated by burning fuel. Burning fuel consumes oxygen. The purpose of using production furnaces to heat and produce hardened pellets is to oxidize the main ingredient of the magnetite pellets. Since burning fuel consumes oxygen, very little oxygen remains in the furnace gasses to initiate the oxidation of magnetite. The low velocity gasses mandate that oxygen enter the pellets by diffusion, which is not the most effective mechanism for introducing oxygen into the center of the pellets. However, the low velocity only effects the pellets on the top of the pellet bed. The solid pellets occupy about 75% of the space that the hot air must travel through. Thus, the air in the lower section of the pellet bed has a velocity of about 2000 feet per minute. In effect, the air must travel a serpentine path through the pellet bed.

A concept that is important to understand is that the pellets on the top of the pellet bed are heated by hot air travelling down over the top pellets. The air velocity is around 400 feet per minute for the top few pellets with the air travelling downwardly impacting only on the top surface of the pellets. Due to the serpentine path mentioned earlier, the air travelling faster at about 2000 feet per minute has the kinetic energy to impinge on the lower surface of the pellet and force some of the air into the granulated structure of the pellet. The air travelling downwardly within the recuperation zone does travel a serpentine path because the pellets being oxidized are deep inside the bed of pellets. A problem with that prior method is there is not much available oxygen in the hot air and gasses in the combustion furnace although most pellet oxidation occur in the recuperation zone of the furnace. The availability of 21% oxygen ensures improved oxidation.

The heat produced by fuel combustion within the furnace is used to heat the pellets to a temperature that initiates the magnetite conversion process. The reaction is exothermic, but is limited because oxygen is used to burn the fuel in the furnace. Heating the air requires about 35% of the available oxygen to produce the heat. Consequently, the oxygen in the air is reduced from 21% to about 13%.

The firing zone of the furnace heats the pellets and starts oxidizing magnetite pellets to hematite. The process is slow because only the top few inches of the pellet bed is oxidized in the firing zone of the furnace. This is consistent with good prior operating practice. The best firing conditions occur in the recuperation section of the furnace. Pellets fired in the combustion zone of a furnace have lower quality because of reduced oxygen, low air velocity plus moisture in the center of the pellets. The magnetite conversion process is complicated because moisture contained in the middle of the pellet requires heat to evaporate the water. Therefore, there is a temperature reduction consistent with the heat of vaporization of water. The tops of the pellet reach a temperature that initiates magnetite conversion, while the center of the pellets are cooler and are not oxidized. The center of the pellet will have water vapor escaping from water of hydration from the additives, if not from water filling the interstitial spaces of the pellets made of granulated magnetite. Thus, the prior practice was complicated because the hot gasses with reduced oxygen initiated the magnetite conversion process on the top section of the pellet structure.

Moreover, the top of a pellet often developed a sealed cap over the unconverted lower half of the pellet. The hot gasses directed down over the pellet did not have the necessary kinetic energy or adequate oxygen to enter the side or bottom of the pellet and complete the conversion process. Therefore a significant portion of the top few inches of the pellet bed was only partially oxidized leaving a magnetite core in the center of most pellets which ideally should have been oxidized to $Fe_2O_3$.

The prior practice followed by pellet producers requires testing the fired pellet to evaluate the pellets compressive strengths such as minus 200-pound breaking percentage, minus 300 pound breaking percentage. Average compression breaking percentage is another standard that is measured. Another measured value is low temperature breakdown, which indicate a pellet's suitability in the blast furnace. There are other variables measured, but the most critical measurement is the FeO, which indicates the amount of ferrous iron present in the finished pellet. The FeO indicates the amount of magnetite present. The FeO indicates the percentage of magnetite that did not become oxidized to hematite. The usual method that furnace operators use to improve the quality measuring parameters is to increase the temperature of the furnace. The end result is increased fuel consumption and this consumes oxygen that could be used to oxidize the pellets.

Several problems characterize the prior art. First, hot gasses travelling downwardly at a low velocity (400 feet per minute) oxidize the top of the pellet. However, oxidation occurs because the hot gasses impact on the top of the top pellets. The gasses force some of the remaining oxygen into the center of the pellet initiating oxidation. The oxidation can become so complete that the top of the pellet becomes sealed by grain growth preventing oxidation from taking place in the lower half of the pellet. The lower half of the top pellet usually has water that prevents heat conduction from raising the temperature to the oxidizing temperature. The sealing of the top of the pellet usually occurs in the higher temperature zones of the furnace. Centers that are not oxidized often occur on pellets with the sealed tops and sealing is associated with grain growth.

A second problem with the prior low velocity hot gasses travelling downwardly, is that the gasses impinge on the top of the top pellets. The flow contours around the top pellets preventing gasses from impinging on the sides or bottom of the pellets, thereby preventing the hot gasses with the reduced oxygen content from being driven into the slightly porous structure. Actually, the mechanism for oxygen entering the center of the individual pellets is through gaseous diffusion in the existing operating practice. Gaseous diffusion does not remove inert gasses such as $N^2$ or introduce new gasses adequately.

A third problem category is the reaction that most furnace operators have when faced with pellet quality problems. The normal reaction is to increase the temperature set points in the various zones of the furnace. Increasing the temperature set points always result in increased fuel consumption which is of course undesirable.

The pellets with the highest FeO are on the top two inches of the pellet bed because the pellets are oxidized in the combustion zone of the furnace. Consider that a furnace producing a FeO of 2% has a total bed depth of 16 inches, then two inches is ⅛th of the bed. It is reasonable to estimate that the top two inches has a FeO of about 16%. The FeO may not be that high, but the top of the pellet bed contributes most of the FeO.

One aspect of this invention is the provision of a hot air distribution system consisting of a fan and distribution ductwork to introduce hot ( 1100° F.) air into the main chamber of a production furnace. The hot air is ducted to blow a jet of hot air about 30 to 45 degrees below horizontal onto the bed of pellets. The air jets will be directed either into or with the direction of travel that the pellets are conveyed on the travelling grates of the pelletizing machine. The hot air jet is directed onto the pellets at the beginning of what is called the preheat zone. The set point temperature for the preheat zone is about 2100° F. The top pellets in the preheat zone are heated to about 2100° F. by the normal pellet heating method via the combustion of fuel. A jet of 1100° F. air will generally mix with the air at 2100° F. in the preheat zone. The combined temperature should average about 1600° F. The air is ejected from the jet at a velocity of about 3000 feet per minute to provide the momentum to accelerate the mixture to about 2000 feet per minute. The mixture has the necessary kinetic energy to force some of the gaseous mixture into the granulated structure of the pellet, thus promoting oxidation in the interior of the pellet structure. The hot air jets have an effect similar to a fan blowing air on the coals in a forge. The hot air jets initiate oxidation and perpetuate the exothermic reaction that occurs when magnetite is converted to hematite depending upon the quantity of oxygen that enters into the reaction. Another way to appreciate the value of hot air jets is to consider that there is no physical reason for gasses that are inert, such as $CO^2$ and $N^2$ to leave the center of a porous structure such as a pellet without being acted upon by an outside force. This invention provides the necessary kinetic energy to introduce an oxygen mixture into the center of the top pellets and at the same time displace the inert gasses that are there. Without the present invention, diffusion would have to move oxygen in and displace the inert gasses. The low velocity gas does have some kinetic energy, but not the quantity that this invention provides. The hot air jets thus provide kinetic energy to air containing oxygen so as to replace the inert gasses present inside the pellets.

In the present application, the air jets can be thought of as slot jets, nozzle jets or fan jets. Other jet configurations can be used to direct hot air under moderate pressure. The number of distribution pipes connected to the jets and the volume or air jet size can be determined by the needs of a particular furnace. Installation of hot air jet distribution pipes in a production furnace does not permit the designer to make changes other than shutting off or reducing flow after a furnace has been started. It is possible to apply too much air with too many distribution pipes to develop too much heat of reaction to create a slightly impervious top of the pellet bed. Good results can be obtained in a typical furnace using six jet distribution pipe sections with about 500 cfm of hot air supplied to each section of distribution pipes in a typical furnace, i.e. 3000-cfm in all. More distribution pipes can be installed initially if the furnace structure permits safe and dependable installation. The number of distribution pipes in this invention will vary depending upon the furnace type and pellet characteristics such as their metallurgical composition.

The present invention provides a very cost effective and efficient method of improving the oxidation of the top few pellets. Preferably, a small volume of pure oxygen is added to the hot air jets by introducing oxygen into the distribution system to raise the 21% oxygen of atmospheric air to a higher percentage, say 25%, or of oxygen depleted air to at least 21% $O^2$, or any percentage that is economically favorable. If the improvement warrants more oxygen, then more can be added. It most likely would not be necessary to add oxygen to every distribution system. The oxygen-enriched air is directed as a jet into the porous structure of the sides and bottom of pellets on top of the pellet bed. In another operating mode, only enough oxygen is added to provide a concentration that which occurs in air, i.e., 21%. The oxygen content can, however, be increased further when further improvements are desired. Added oxygen can also be used to provide energy in the form of heat to reduce the fuel used to produce pellets.

The hot air distribution system also provides hot air jets in the firebrick area above windbox 13 and windbox 14 on furnaces equipped with radiant heat reflectors 108–111 or on furnaces without radiant heat reflectors. This invention improves the operation of furnaces used to oxidize magnetite to hematite and on furnaces pelletizing hematite and limonite. Optimum benefits are achieved when the furnaces are equipped with air jets to dry the top pellets in the drying zones of the furnace. Additional benefits are realized in furnaces equipped with the radiant heat reflectors 108–110.

This invention improves the quality of pellets to the extent that it is economically advisable to increase the capacity of the furnace in tons/hr. by at least 10%. If the addition of pure oxygen is also used to improve the pellet quality, the operating capacity is calculated to be increased by an additional 10% or 15%.

The heat generated by the exothermic reaction from the conversion of magnetite to hematite will permit the furnace operators the opportunity to shut off the burners in many areas in the furnace. If desired, more hot air jets can be used to obtain the maximum benefit of fuel reduction. Oxygen enriched hot air jets, when used, provide more heat of reaction to ensure that pellet quality can be obtained with increased tonnage and reduced fuel consumption. Typical fuel reduction is calculated to be at least 25%.

During operation, the jets provide the kinetic energy to introduce gasses containing 21% oxygen into the top pellets of a pelletizing machine. Even when the oxygen content of the jet is below 21%, the gas mixture with increased kinetic energy will provide more oxygen than without the present invention. Oxygen enrichment improves the oxidation of the magnetite to hematite and increases the exothermic reaction to provide more heat. The end result reduces the fuel required to produce pellets.

Thus, the invention provides means for introducing hot air through jets to supply oxygen into the center of pellets such as the top 3 inches of a total pellet bed depth of about 18 inches or whatever depth the pelletizing machine normally operates. The introduction of pure oxygen to enrich the air from the jets improves the oxidation potential of the resulting mixture of gasses. The increased oxygen will increase the heat of reaction and reduces the fuel consumption for the furnace. Moreover, the operating efficiency of the furnace is thus improved by increasing the tons of ore processed per operating hour. The pellet quality is also improved by the use of this invention. With or without oxygen there is improved product quality and better cost efficiency due to increased production and lower fuel consumption.

In the present invention the jets are preferably supplied with hot air that is available from the heat recovery zone of most pelletizing furnaces. Other hot air sources may be available on furnaces of different operating configurations. The hot air jets are preferably directed at an angle of about 30°–45° into or with the direction that pellets are conveyed on a travelling grate pelletizing machine. An important advantage is that the hot air jets provide the necessary kinetic energy to force hot gasses containing oxygen into the center portion of pellets to convert magnetite to hematite. The conversion process provides heat of reaction to heat adjacent pellets and pellets below the area that the reaction is occurring. Furnaces operating with ores other than magnetite benefit by the hot air jets having the kinetic energy to introduce hot gasses into the center of the pellet rather than relying on diffusion introducing hot gasses into the center of the pellet.

The hot air jets are used wherever needed throughout the various zones of the furnace. Additionally hot air distribution pipes are placed under and near the firebrick zone of applicable furnaces.

Various modifications can be made. For example, a different type of hot air distribution pipe shown in FIGS. 22 and 23 can be used especially for test purposes to bring heated air through the sides of the furnace from outside manifolds. The same short distribution pipe can be used in the hotter zones of the furnace. Distribution pipes of any kind used inside the furnace can have auxiliary cooling pipes around or along side them at 113 (FIG. 22) to provide cool air to protect the distribution pipes. Additionally, the distribution pipes can have insulation 317 surrounding them that provide further protection from the hot gasses in the furnace.

The improvement to furnace operation provided by the hot air jets using standard air at 21% oxygen is increased by the judicial addition of oxygen injected into the hot air jet supply line. Fuel reduction is possible with hot air jets containing 21% oxygen. However, oxygen enriched air containing over 21% oxygen results in even greater fuel reduction. Moreover, the hot air jets increase furnace production rates and result in product quality improvements with either standard air or oxygen enriched air. Fuel reduction is an added advantage.

One feature of the present invention is the introduction of hot air under moderate pressure to distribution pipes placed close to the top of a bed of pellets on a travelling grate conveyor that is part of a pellet firing oven. The hot air jets at a temperature nearly 1,100° F. have sufficient velocity (3,000 ft. per minute or more) to mix with hot combustion gasses with an average temperature of 2,100° F. to produce a jet of air directed toward the top pellets that have been heated to nearly 2,100° F. The resultant jet of hot air directs gas with increased oxygen content into the finely ground magnetite particles of the pellet. Before reaching the jets, the normal heating of the pellet bed has already increased the temperature of the pellets as the pellets are conveyed through the furnace. The hot air jets then force heated gas into the progressively higher temperature pellets. The hot air jets make possible a greater potential for magnetite oxidation due to air with increased kinetic energy impacting on the lower half of the pellet. While the hot air jets impact on the top surfaces of each pellet more than on the lower half, the main benefit of the hot air jets is the additional oxidation that occurs within the pellets and on the lower surfaces of pellets.

To further clarify the previous paragraph, it is pointed out that the hot air jets force oxygen into the top half of the top pellets. The net effect is to increase oxidation of the upper cap like portion of the top pellets. Since the top of the top pellets on the pellet bed are heated by the combustion gasses first and to a higher temperature, the top cap of the pellet is frequently sealed by grain growth to an impervious cap preventing gasses from transporting oxygen to the center of the pellet. With the direction of gasses being basically vertical, the lower portion of the top pellets receive oxygen by gaseous diffusion. However, gaseous diffusion does not adequately supply oxygen into the center of the top pellets, thus leaving a substantial amount of magnetite that is not converted to hematite resulting in a higher than desired FeO.

The hot air jets described in this invention will oxidize most of the top layer of pellets. The top of the top pellets will be heated to a much higher temperature than the lower half of the pellets. The hot air jet blowing oxygenated air on and into the top portion of the pellet increases the oxidation rate and consequently the temperature of the top portion of the pellets. The top of each pellet will be heated more by the normal combustion gasses of the furnace. Consequently, grain growth will begin to seal the top portion of the hot pellets. The most effective means of introducing oxygen into the lower half and center of the pellets is the hot air jets described herein. The hot air jets may introduce oxygen into the top portion of a pellet if the pellet is not sealed. Eventually the top of the pellet will become sealed. Normal gaseous diffusion that occurs without the present invention will not efficiently displace inert gasses and force oxygen into the center of the pellet.

The oxidizing effect of the invention just described takes place with the pellets on the top layer of the pellet bed. The next inch has the advantage of more time exposed to high heat and will be drier. The effect of high heat from the normal furnace heating process more uniformly heats both the top and lower portion of each pellet. The effect of the hot air jet used in accordance with the present invention is to provide the kinetic energy to force oxygen into both the top and lower portion of the pellet. The end result will be pellets with more magnetite oxidized to hematite. The same effect occurs on the next inch of pellet depth, but the effect is less from the effect of the hot air jets and more from the serpentine pathway the gasses must travel as they are drawn through the pellet bed.

It should be understood that the exposure of any pellet to the high velocity hot air jet is for a very short duration. An individual pellet on or near the top of the pellet bed is exposed to the hot air jet for about one half of a second. The use of six hot air jet distribution pipes exposes an individual pellet to about three seconds of the high velocity hot air jet action. If desired, hot air jets can be made wider to increase the exposure time and more distribution pipes can be used. Oxygen enriched air is also added if desired to provide an increased heat of reaction.

Each distribution pipe provides hot air jets over only half of the width of the furnace. The other half of the furnace has distribution pipes providing hot air jets on the other side (FIGS. 22 and 23). This arrangement permits changing distribution pipes if they become warped or if different jet widths are desired. The shorter designed distribution pipes permit their use in hotter sections of the furnace and permit operating the furnace with greater fuel reduction.

In one operating method, selected burner pairs across from each other both provide air that is hotter than standard furnace air at that location to furnish high temperature pellets across the width of the furnace. The hot air jets are operated to provide air with adequate oxygen to sustain and preferably accelerate the heat of reaction in areas that have the main burners shut off. In the event that the hot air jet distribution pipes closest to the operating burners become warped and do not provide hot air in the desired direction, the next set of burners are operated during the time that the initial burners are shut off. The warped hot air jets can be replaced and the burners returned to the original operating configuration. The short hot air jet distribution pipes permit replacement in a reasonable time period. Improvements in pipe metallurgy can be used to provide distribution pipes with greater heat resistance.

The hot air jets installed toward the outlet of the furnace provide oxygen to oxidize magnetite wherever the temperature is high enough to accelerate the conversion. Hot air jets located near the firebrick area accelerate the magnetite conversion and provide heat to continue oxidizing magnetite in the heat recuperation zone utilizing hot air with 21% oxygen. Opposing burners nearest the firebrick area can be operated to increase the pellet temperature beneath the firebricks to provide radiant heat from the firebricks and also to have adequate heat on furnaces with additional radiant heat reflectors. Strategically placed hot air jets induce the flow of air with oxygen under the firebrick zone, thereby starting the oxidation of pellets with 21% oxygen about 30 seconds sooner than without the use of jets. The induced flow of hot atmospheric air can increase the furnace operating capacity by more than 10 tons per operating hour. Increased operating capacity and reduced fuel consumption by use of the present invention provides an improved cost benefit primarily due to an increase in the overall efficiency of the furnace operation.

Refer again to FIG. 17. The pellet drying mechanism and heat conservation raises the average temperature in all windboxes in the recuperation zone of production furnaces. As shown in FIG. 17, tempering air is introduced into duct 262 under the control of a damper 1000. The temperature control by damper 1000 results in lowered negative air pressure (suction) developed by the recuperation fan 106. The lower negative pressure, however, could defeat the purpose of the recuperation fan, which is to promote the oxidation of magnetite pellets to hematite pellets in the most energy efficient manner in the recuperation zone. See FIG. 14. Another purpose of the recuperation fan is to provide as much high heat capacity air as possible to the forced draft fan 34 for drying pellets (FIG. 12).

FIG. 17 shows a tempering air temperature control sensor 1001 at the inlet of fan 106 that is connected to cause tempering air damper 1000 to open in response to high temperature air above the recommended temperature, say above 850° F. so that less air is drawn through the pellet bed. Therefore, the pellets will not be oxidized as efficiently in the recuperation zone. The most common method previously used to improve the oxidation of pellets was to reduce the quantity of pellets produced. However, this action makes the air hotter causing the tempering air damper 1000 to open more. The use of the tempering air damper 1000 to control (or limit) the temperature of the air through the recuperation fan 106 can also be replaced with a more effective method that will permit more air to pass through the pellet bed and also retain the high heat capacity supply for the updraft drying fan 34 (FIG. 1). This method will now be described with reference to FIG. 17.

In FIG. 17 as the air temperature changes from 800° F. to 1200° F. by passing the pellet firing zone (see FIG. 14) the air volume changes but the weight of air per minute remains constant. When the temperature changes the density and volume changes but the weight remains constant. The opening of the tempering air damper 1000, reduces the negative pressure at 14 inches water gauge suction of the recuperation fan so that the suction pressure is reduced to about 13.5 inches water gauge. This reduction has a definite impact on the efficiency of the recuperation fan. Therefore, the opening of the tempering air damper 1000 lowers the efficiency across the entire recuperation zone by 33%, divided by 9 windboxes equals 3.7% per windbox. This is a significant reduction in efficiency, however in accordance with the invention, water is sprayed into the recuperation air by a spray head 1002 before entering recuperation fan 106. It can be calculated that in a typical installation the water spray from spray head 1002 provides an increase in the efficiency of recuperation from 106 by about 3.2% per windbox or 6033 BTU's per windbox when compared to using the tempering air damper 1000 for temperature control. Thus, the use of the water sprays from spray head 1002 provides control of temperature without a reduction in heat capacity.

Refer now to FIG. 20. In a typical furnace, the moisture added by spray head 309 can provide a saving of $100,000 or more a year. The reason for this improvement is the elevated heat capacity of the air caused by the addition of water at spray head 309 which increases the sensible heat transfer of the air. Moreover, the water vapor condenses on the cooler pellets that are at approximately 70° F. to 80° F., thus the pellets absorb the heat of condensation namely 970 BTU's per pound of water and are therefore further heated in this way thereby helping to vaporize the liquid water contained within them. Typically, pellets at 70–80° F. will be warmed by this means to about 120° F. If desired, the outlet of the recuperation fan can be connected like the recuperation fan 106 in FIG. 12 to feed hot air upstream to an earlier stage of drying to thereby transfer water from spray head 1002 to an earlier drying stage such as the updraft drying zone 50.

Another feature of the invention will now be described in connection with FIG. 18. In windbox number 5 is provided a flapper seal 35 of known construction to help form a seal between the bottom of the conveyor 24 and windbox 5 for reducing the flow of hot air from the updraft drying zone (located to the left of wall 115) which is generally at a pressure of about 30 inches of water gauge positive pressure into the downdraft drying zone 20 which is generally at a lower pressure of about 10 inches water gauge negative pressure. The leakage of air between these zones is indicated by the arrows 37. In accordance with the present invention, the hot air 37 that leaks from the updraft drying zone is blown for example by means of a fan 57 through a duct 59 and can be used in any of a variety of ways. It can be used for example to feed air to a forced draft fan 34 which communicates with windboxes 1–5 to blow hot air up through the pellet bed. Part or all of the flow of recirculated air 37 that is collected by the fan 57 can be blown if desired out through the jets 36 within the updraft drying zone onto the pellet bed. If desired, part of the recirculated air 37 can be collected by the waste gas fan 106. The recirculated air 37 that leaks from the updraft drying zone can be blown by means of the fan 57 to other parts of the furnace for any of a variety of uses that will be apparent to those skilled in the art. An important advantage of this feature of the invention is that it adds to the economy of operation and reduces waste heat by capturing the hot air that leaks past the flapper seal 35. This feature of the invention is especially of value in cold climates where furnaces are operated in buildings that are cold. It can also be used to provide additional hot air as needed to heat or dry pellets. A further advantage of this feature is the provision of additional capacity for the waste gas fan 106 to collect contaminated air from the furnace.

Many variations of the present invention within the scope of the appended claims will be apparent to those skilled in the art once the principles described herein are understood.

What is claimed is:

1. A method of drying iron ore pellets in a furnace comprising the steps of:

forming moisture-containing pellets into a bed comprising a multiplicity of the pellets, said bed having an upper and a lower surface, forcing a current of drying air downwardly through the upper surface of the bed of pellets in a downdraft drying zone and directing at least one jet of air containing added oxygen downwardly onto the bed within a firing zone of the furnace.

2. The method of claim 1 wherein the bed of pellets is advanced through the downdraft drying zone to a recuperation zone and air from the recuperation zone is enriched with said added oxygen and is then used to provide said jet of air in the firing zone.

3. The method of claim 1 wherein the jet is directed downwardly at an inclined angle onto said bed in the firing zone.

4. An apparatus for drying iron ore pellets comprising, means forming moisture-containing pellets into a bed comprising a multiplicity of the pellets, said bed having an upper and a lower surface, means forcing a current of firing gas through the bed of pellets, means for adding oxygen to the firing gas and a duct for supplying the firing gas having added oxygen to the pellet bed.

5. The apparatus of claim 4 wherein air having added oxygen is directed onto the bed in the firing zone by a fan.

6. The apparatus of claim 4 including a duct for forcing air to which oxygen has been added onto a surface of the pellet bed as a jet of air in the firing zone of the furnace.

7. The apparatus of claim 6 wherein the jet of air is angled downwardly on an incline toward the bed in the firing zone of the furnace.

8. The apparatus of claim 4 wherein the air duct is cooled by exposing the air duct to a cooling medium.

9. The apparatus of claim 4 wherein the air duct is insulated.

10. The apparatus of claim 4 wherein the air duct is provided with a jet nozzle that is aimed generally in the direction of a path taken by the pellets and at an oblique angle thereto.

11. An apparatus for drying iron ore pellets comprising, a support for moisture-containing pellets as a bed comprising a multiplicity of the pellets, said bed having an upper and a lower surface, a furnace having an air mover to transfer a current of drying gas through the bed of pellets, a conveyor in the furnace to advance the pellets from one heating zone to a downstream heating zone, an air duct for recirculating air from the downstream heating zone to a furnace zone upstream thereof and a cool air inlet connected to the duct for admitting lower temperature air thereinto to cool the recirculated air such that cooled recirculated air is directed to the pellets in the upstream zone.

12. The apparatus of claim 11 wherein the recirculated air is passed through a jet nozzle and expelled as a jet of air that is directed onto a surface of the pellet bed in the upstream zone.

13. The apparatus of claim 12 wherein a plurality of said jets are positioned above the bed and each jet of air is directed toward the upper surface of the bed.

14. The apparatus of claim 11 wherein water is introduced into the recirculated air to raise the moisture vapor content thereof.

15. An apparatus for drying iron ore pellets comprising, a support for moisture-containing pellets as a bed comprising a multiplicity of the pellets, said bed having an upper and a lower surface, a furnace having an air mover to transfer a current of drying gas through the bed of pellets, a conveyor in the furnace to advance the pellets from a first heating zone of the furnace to a second heating zone, an air duct for circulating air from one of the heating zones to a different heating zone and a water inlet for feeding water into the circulating duct air to raise the moisture vapor content thereof.

16. The apparatus of claim 15 wherein the circulated air is passed through a jet nozzle as a jet of air that is directed onto a surface of the pellet bed in an upstream zone of the furnace.

17. The apparatus of claim 15 wherein an inlet is connected to the duct for introducing air that is cooler than the air in the duct to lower the temperature of the air therein before the air is circulated to the pellet bed to protect a fan from overheating.

18. The apparatus of claim 17 wherein a damper valve is connected to the inlet and a temperature probe is provided in the duct to measure the temperature of the circulated air for controlling the damper such that the circulated air is maintained below a selected temperature.

19. The apparatus of claim 12 wherein the jet is directed from at least one side of the furnace toward the center thereof at an oblique angle.

20. The apparatus of claim 16 wherein the jet is directed from at least one side of the furnace toward the center thereof at an oblique angle.

21. The apparatus of claim 12 wherein air passed to the jet nozzle is passed through a duct that is protected from becoming overheated within the furnace.

22. The apparatus of claim 16 wherein air passed to the jet nozzle is passed through a duct that is protected from becoming overheated within the furnace.

23. The apparatus of claim 12 wherein the jet of air is directed downwardly onto the upper surface of the bed at an inclined angle.

24. The apparatus of claim 16 wherein the jet of air is directed downwardly onto the upper surface of the bed at an inclined angle.

25. The apparatus of claim 11 wherein the downstream heating zone is a recuperation zone.

26. An apparatus for drying iron ore pellets comprising, a support for moisture-containing pellets as a bed comprising a multiplicity of the pellets, said bed having an upper and a lower surface, a furnace having an air mover to transfer a current of drying gas through the bed of pellets, a conveyor in the furnace to advance the pellets from a first heating zone of the furnace to a second heating zone, a flapper seal is provided between said first heating zone and said second heating zone below said conveyor to partially seal the first zone of the furnace from the second zone such that hot air leaks from the first zone of the furnace to the second zone past the flapper seal and means to withdraw and blow the hot air that leaks into the second zone of the furnace into a selected zone of the furnace for drying the pellets.

27. The apparatus of claim 26 wherein the first zone of the furnace is an updraft drying zone and the second zone of the furnace is a downdraft drying zone.

28. The apparatus of claim 26 wherein the hot air that leaks into the second zone of the furnace is blown upwardly through the bed of pellets in an updraft drying zone.

29. The apparatus of claim 26 wherein the hot air that leaks into the second zone of the furnace is blown through jets onto the bed of pellets.

30. The apparatus of claim 26 wherein the hot air that leaks into the second zone of the furnace is blown to a forced draft fan that is connected to an inlet of an updraft drying zone to provide hot air to the updraft drying zone.

* * * * *